US009111481B2

(12) United States Patent
Ono

(10) Patent No.: US 9,111,481 B2
(45) **Date of Patent: *Aug. 18, 2015**

(54) DISPLAY DEVICE AND METHOD OF DRIVING THE SAME

(71) Applicant: JOLED INC., Tokyo (JP)

(72) Inventor: Shinya Ono, Osaka (JP)

(73) Assignee: JOLED INC., Tokyo (JP)

( * ) Notice: Subject to any disclaimer, the term of this patent is extended or adjusted under 35 U.S.C. 154(b) by 175 days.

This patent is subject to a terminal disclaimer.

(21) Appl. No.: 13/778,201

(22) Filed: Feb. 27, 2013

(65) Prior Publication Data

US 2013/0169702 A1 Jul. 4, 2013

Related U.S. Application Data

(63) Continuation of application No. PCT/JP2010/005453, filed on Sep. 6, 2010.

(51) Int. Cl.
*G09G 5/10* (2006.01)
*G09G 3/32* (2006.01)

(52) U.S. Cl.
CPC ..... *G09G 5/10* (2013.01); *G09G 3/3233* (2013.01); *G09G 2300/0819* (2013.01); *G09G 2300/0852* (2013.01); *G09G 2300/0861* (2013.01); *G09G 2320/043* (2013.01)

(58) Field of Classification Search
CPC . G09G 3/325; G09G 3/12; G09G 2320/0233; G09G 3/30; G09G 3/3291
USPC ..... 345/77, 78, 82, 84, 690
See application file for complete search history.

(56) References Cited

U.S. PATENT DOCUMENTS 6,229,506 B1 5/2001 Dawson et al.
7,365,713 B2 4/2008 Kimura
(Continued)

FOREIGN PATENT DOCUMENTS

CN 1541033 10/2004
JP 2002-514320 5/2002
(Continued)

OTHER PUBLICATIONS

Yumoto et al., "Pixel-Driving Methods for large-Sized Poly-Si AM-OLED Displays", Asia Display /IDW, 2001, pp. 1395-1398.
(Continued)

*Primary Examiner* — Abbas Abdulselam
*Assistant Examiner* — Gerald Oliver
(74) *Attorney, Agent, or Firm* — Greenblum & Bernstein, P.L.C.

(57) ABSTRACT

A display device including pixels has formed therein at least two drive blocks each made up of pixel rows. Each of the pixels includes: a drive transistor; a first electrostatic capacitor and a second electrostatic capacitor; an organic EL element; a first switching transistor provided between the source and the drain of the drive transistor; and a second switching transistor that supplies a signal current to the organic EL element. Each of the pixels in a kth drive block includes a third switching transistor provided between a first signal line and the first electrostatic storing capacitor, and each of the pixels in a k-th drive block includes a fourth switching transistor provided between a second signal line and the first electrostatic storing capacitor. A second control line for controlling conduction of the first switching transistor is connected to each of the pixels in a same one of the drive blocks.

10 Claims, 15 Drawing Sheets

(56) References Cited

U.S. PATENT DOCUMENTS

| | | | | |
|---|---|---|---|---|
| 7,397,447 | B2 | 7/2008 | Matsumoto | |
| 8,035,109 | B2 | 10/2011 | Kimura | |
| 8,054,298 | B2 | 11/2011 | Asano et al. | |
| 8,305,307 | B2 | 11/2012 | Ono | |
| 8,305,308 | B2 | 11/2012 | Ono | |
| 8,355,016 | B2 | 1/2013 | Odawara et al. | |
| 2003/0117352 | A1 | 6/2003 | Kimura | |
| 2004/0233141 | A1 | 11/2004 | Matsumoto | |
| 2006/0097966 | A1 | 5/2006 | Choi | |
| 2006/0158398 | A1* | 7/2006 | Akimoto et al. | 345/77 |
| 2008/0158114 | A1* | 7/2008 | Kim | 345/77 |
| 2008/0284312 | A1 | 11/2008 | Kimura | |
| 2009/0122047 | A1 | 5/2009 | Yamamoto | |
| 2009/0174699 | A1 | 7/2009 | Fish et al. | |
| 2009/0244055 | A1 | 10/2009 | Asano et al. | |
| 2011/0181192 | A1 | 7/2011 | Ono | |
| 2012/0025193 | A1 | 2/2012 | Kimura | |
| 2012/0176422 | A1 | 7/2012 | Ono | |

FOREIGN PATENT DOCUMENTS

| | | |
|---|---|---|
| JP | 2003-186439 | 7/2003 |
| JP | 2003-195809 | 7/2003 |
| JP | 2003-202834 | 7/2003 |
| JP | 2006-133731 | 5/2006 |
| JP | 2007-522492 | 8/2007 |
| JP | 2008-122633 | 5/2008 |
| JP | 2009-139928 | 6/2009 |
| JP | 2009-237041 | 10/2009 |
| JP | 2010-054564 | 3/2010 |
| WO | 98/48403 | 10/1998 |
| WO | 2005/069266 | 7/2005 |
| WO | 2010100938 | 9/2010 |

OTHER PUBLICATIONS

Office Action and Search Report from the Patent Office of the People's Republic of China in Chinese Patent Application No. 201080068950.8, dated Dec. 31, 2014, along with an English language translation of the Search Report.

Zhong Rui et al., "Design of LCD Multi Line Selection Driver IC", Research & Progress of SSE, vol. 23, No. 4, pp. 447-453, dated Nov. 30, 2003.

* cited by examiner

Pixel in odd block

Pixel in even block

Pixel in odd block

Pixel in even block

DISPLAY DEVICE AND METHOD OF DRIVING THE SAME

CROSS REFERENCE TO RELATED APPLICATION

This is a continuation application of PCT Patent Application No. PCT/JP2010/005453 filed on Sep. 6, 2010, designating the United States of America. The entire disclosure of the above-identified application, including the specification, drawings and claims are incorporated herein by reference in its entirety.

FIELD

One or more exemplary embodiments disclosed herein relate generally to display devices and methods of driving the same, and relate particularly to a display device using current-driven light-emitting elements, and a method of driving the same.

BACKGROUND

Display devices using organic electroluminescence (EL) elements are well-known as display devices using current-driven light-emitting elements. An organic EL display device using such self-luminous organic EL elements does not require backlights needed in a liquid crystal display device and is best suited for increasing device thinness. Furthermore, since viewing angle is not restricted, practical application as a next-generation display device is expected. Furthermore, the organic EL elements used in the organic EL display device are different from liquid crystal cells which are controlled according to the voltage applied thereto, in that the luminance of the respective light-emitting elements is controlled according to the value of the current flowing thereto.

In the organic EL display device, the organic EL elements included in the pixels are normally arranged in rows and columns. In an organic EL display referred to as a passive-matrix organic EL display, an organic EL element is provided at each crosspoint between row electrodes (scanning lines) and column electrodes (data lines), and such organic EL elements are driven by applying a voltage equivalent to a data signal, between a selected row electrode and the column electrodes.

On the other hand, in an organic EL display device referred to as an active-matrix organic EL display device, a switching thin film transistor (TFT) is provided in each crosspoint between scanning lines and data lines, the gate of a drive element is connected to the switching TFT, the switching TFT is turned ON through a selected scanning line so as to input a data signal from a signal line to the drive element, and an organic EL element is driven by such drive element. A display device in which the organic EL element is driven by such a driving element is called an active-matrix organic EL display device.

Unlike in the passive-matrix organic EL display device where, only during the period in which each of the row electrodes (scanning lines) is selected, does the organic EL element connected to the selected row electrode emit light, in the active-matrix organic EL display device, it is possible to cause the organic EL element to emit light until a subsequent scan (selection), and thus a reduction in display luminance is not incurred even when the duty ratio increases. Therefore, the active-matrix organic EL display device can be driven with low voltage and thus allows for reduced power consumption. However, in the active-matrix organic EL display device, due to variation in the characteristics of the drive transistors, the luminance of the organic EL elements are different among the respective pixels even when the same data signal is supplied, and thus there is the disadvantage of the occurrence of luminance unevenness.

In response to this problem, for example, Patent Literature (PTL) 1 discloses a method of compensating for the variation of characteristics for each pixel using a simple pixel circuit, as a method of compensating for the luminance unevenness caused by the variation in the characteristics of the drive transistors.

FIG. 12 is a block diagram showing the configuration of a conventional image display device disclosed in PTL 1. An image display device 500 shown in the figure includes a pixel array unit 502 and a drive unit which drives the pixel array unit 502. The pixel array unit 502 includes scanning lines 701 to 70*m* disposed on a row basis, and signal lines 601 to 60*n* disposed on a column basis, pixels 501 each of which is disposed on a part at which both a scanning line and a signal line cross, and power supply lines 801 to 80*m* disposed on a row basis. Furthermore, the drive unit includes a signal selector 503, a scanning line drive unit 504, and a power supply line drive unit 505.

The scanning line drive unit 504 performs line-sequential scanning of the pixels 501 on a per row basis, by sequentially supplying control signals on a horizontal cycle (1 H) to each of the scanning lines 701 to 70*m*. The power supply line drive unit 505 supplies, to each of the power supply lines 801 to 80*m*, power source voltage that switches between a first voltage and a second voltage, in accordance with the line-sequential scanning. The signal selector 503 supplies, to the signal lines 601 to 60*n* that are in columns, a reference voltage and a luminance signal voltage which serves as an image signal, switching between the two voltages in accordance with the line-sequential scanning.

Here, two each of the respective signal lines 601 to 60*n* in columns are disposed per column; one of the signal lines supplies the reference voltage and the luminance signal voltage to the pixels 501 in an odd row, and the other of the signal lines supplies the reference voltage and the luminance signal voltage to the pixels 501 in an even row.

FIG. 13 is a circuit configuration diagram for a pixel included in the conventional image display device disclosed in PTL 1. It should be noted that the figure shows the pixel 501 in the first row and the first column. The scanning line 701, the power supply line 801, and the signal lines 601 are provided to this pixel 501. It should be noted that one out of the two lines of the signal lines 601 is connected to this pixel 501. The pixel 501 includes a switching transistor 511, a drive transistor 512, a storing capacitor 513, and a light-emitting element 514. The switching transistor 511 has a gate connected to the scanning line 701, one of a source and a drain connected to the signal line 601, and the other connected to the gate of the drive transistor 512. The drive transistor 512 has a source connected to the anode of the light-emitting element 514 and a drain connected to the power supply line 801. The light-emitting element 514 has a cathode connected to a grounding line 515. The storing capacitor 513 is connected to the source and gate of the drive transistor 512.

In the above-described configuration, the power supply line drive unit 505 switches the voltage of the power supply line 801, from a first voltage (high-voltage) to a second voltage (low-voltage), when the voltage of the signal line 601 is the reference voltage. Likewise, when the voltage of the signal line 601 is the reference voltage, the scanning line drive unit 504 sets the voltage of the scanning line 701 to an "H" level and causes the switching transistor 511 to be in a conductive state so as to apply the reference voltage to the gate of the drive transistor 512 and set the source of the drive transistor 512 to the second voltage. With the above-described operation, preparation for the correction of a threshold voltage Vth of the drive transistor 512 is completed. Next, in the correction period before the voltage of the signal line 601 switches from the reference voltage to the luminance signal voltage, the power supply line drive unit 505 switches the voltage of the power supply line 801, from the second voltage to the first voltage, and causes a voltage equivalent to the threshold voltage Vth of the drive transistor 512 to be stored in the storing capacitor 513. Next, the power supply line drive unit 505 sets the voltage of the switching transistor 511 to the "H" level and causes the luminance signal voltage to be stored in the storing capacitor 513. Specifically, the luminance signal voltage is added to the previously held voltage equivalent to the threshold voltage Vth of the drive transistor 512, and written in the storing capacitor 513. Then, the drive transistor 512 receives a supply of current from the power supply line 801 to which the first voltage is being applied, and supplies the light-emitting element 514 with a drive current corresponding to the held voltage.

In the above-described operation, the period of time during which the standard voltage is applied to the respective signal lines is prolonged through the placement of two of the signal lines 601 in every column. This secures the correction period for storing the voltage equivalent to the threshold voltage Vth of the drive transistor 512 in the storing capacitor 513.

FIG. 14 is an operation timing chart for the image display device disclosed in PTL 1. The figure describes, sequentially from the top, the signal waveforms of: the scanning line 701 and the power supply line 801 of the first line; the scanning line 702 and the power supply line 802 of the second line; the scanning line 703 and the power supply line 803 of the third line; the signal line allocated to the pixel of an odd row; and the signal line allocated to the pixel of an even row. The scanning signal applied to the scanning lines sequentially shifts 1 line for every 1 horizontal period (1 H). The scanning signal applied to the scanning lines for one line includes two pulses. The time width of the first pulse is long at 1 H or more. The time width of the second pulse is narrow and is part of 1 H. The first pulse corresponds to the above-described threshold voltage correction period, and the second pulse corresponds to a signal voltage sampling period and a mobility correction period. Furthermore, the power source pulse supplied to the power supply lines also shifts 1 line for every 1 H cycle. In contrast, the signal voltage is applied once every 2 H to the respective signal lines, and thus it is possible to ensure that the period of time during which the standard voltage is applied is 1 H or more.

In this manner, in the conventional image display device disclosed in PTL 1, even when there is a variation in the threshold voltage Vth of the drive transistor 512 for each pixel, by ensuring a sufficient threshold voltage correction period, the variation is canceled on a pixel basis, and unevenness in the luminance of an image is inhibited.

CITATION LIST

Patent Literature

[PTL 1] Japanese Unexamined Patent Application Publication No. 2008-122633

SUMMARY

Technical Problem

However, in the conventional technique, there is the problem that the signal output load on the scanning line drive circuit and the power supply line drive circuit increases as the area of the display panel increases, and the problem that precise correction is difficult because the threshold voltage correction period is short.

In view of the aforementioned problems, one non-limiting and exemplary embodiment provides a display device having decreased drive circuit output load and improved display quality due to precise threshold voltage correction.

Solution to Problem

In one general aspect, the techniques disclosed here feature a display device including pixels arranged in rows and columns, the display device including: a first signal line and a second signal line which are disposed in each of the columns, for supplying the pixels with a signal voltage that determines luminance of the pixels; a first power source line and a second power source line; a scanning line disposed in each of the rows; and a first control line and a second control line which are disposed in each of the rows, wherein the pixels compose at least two driving blocks each of which includes at least two of the rows, each of the pixels includes: a light-emitting element that includes terminals, one of the terminals being connected to the second power source line, the light-emitting element emitting light according to a flow of a signal current corresponding to the signal voltage; a drive transistor that includes a gate, a source, and a drain and converts the signal voltage applied between the gate and the source of the drive transistor into the signal current, one of the source and the drain being connected to the first power source line; a first capacitive element that includes terminals, one of the terminals being connected to the gate of the drive transistor; a second capacitive element that includes terminals, one of the terminals being connected to the one or the other of the terminals of the first capacitive element, and the other of the terminals being connected to the source of the drive transistor; a first switching transistor that includes a gate connected to the second control line, one of a source and a drain connected to the gate of the drive transistor, and the other of the source and the drain connected to the drain of the drive transistor; and a second switching transistor that includes a gate connected to the first control line, and a source and a drain which are arranged between the other of the source and the drain of the drive transistor and the other of the terminals of the light-emitting element, each of the pixels in a kth drive block of the drive blocks further includes a third switching transistor that includes a gate connected to the scanning line, one of a source and a drain connected to the first signal line, and the other of the source and the drain connected to the other of the terminals of the first capacitive element, k being a positive integer, each of the pixels in a (k+1)th drive block of the drive blocks further includes a fourth switching transistor that includes a gate connected to the scanning line, one of a source and a drain connected to the second signal line, and the other of the source and the drain connected to the other of the terminals of the first capacitive element, and the second control line is connected to the pixels in a same one of the drive blocks and not connected to the pixels in different ones of the drive blocks.

These general and specific aspects may be implemented using a system, a method, an integrated circuit, a computer program, or a computer-readable recording medium such as a CD-ROM, or any combination of systems, methods, integrated circuits, computer programs, or computer-readable recording media.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

According to the display device and the method of driving the same according to one or more exemplary embodiments or features disclosed herein, the drive transistor correction periods as well as the timings thereof can be made uniform within a drive block, and thus the number of times that the signal level is switched from ON to OFF and from OFF to ON can be reduced and thus reducing the load on the drive circuit that drives the respective circuits of the pixels. In addition, through the above-described grouping into drive blocks and the two signal lines provided for each pixel column, the drive transistor threshold voltage correction period can occupy a large part of a 1-frame period, and thus a precise drive current flows to the light-emitting elements and image display quality improves.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 2 B is a specific circuit configuration diagram of a pixel in an even drive block in the display device according to Embodiment 1 in the present disclosure.

DESCRIPTION OF EMBODIMENTS

Figure 1:
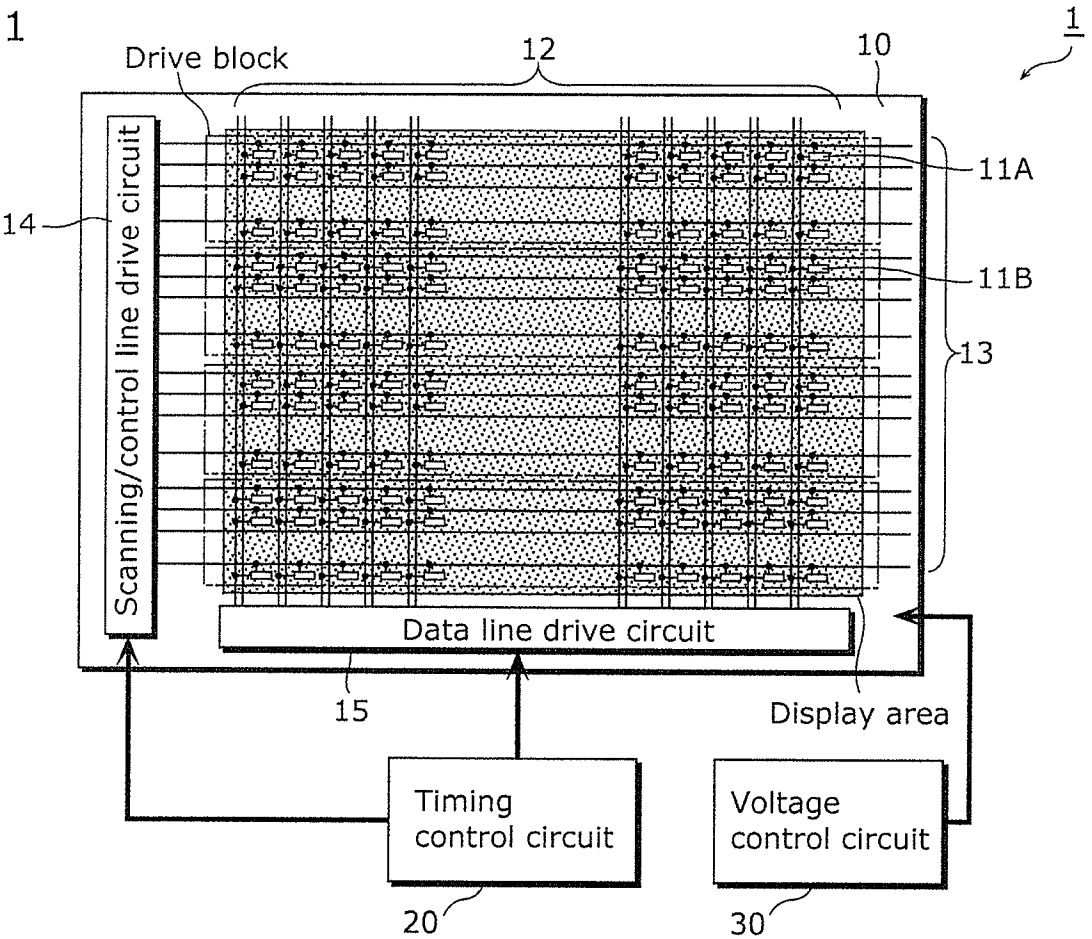
FIG. 1 is a block diagram showing the electrical configuration of a display device according to Embodiment 1 in the present disclosure.

In the conventional image display device disclosed in PTL 1, there is frequent turning ON and OFF of the signal level of the scanning lines and power supply lines provided to each of the pixel rows. For example, the threshold voltage correction period needs to be set for each of the pixel rows. Furthermore, when sampling luminance signal voltage from a signal line via a switching transistor, light-emitting periods need to be provided successively. Therefore, the threshold voltage correction timing and light-emission timing for each pixel row needs to be set. As such, since the number of rows increases with an increase in the area of a display panel, the signals outputted from each drive circuit increases and the frequency for the signal switching thereof rises, and the signal output load on the scanning line drive circuit and the power supply line drive circuit increases.

Furthermore, in the conventional image display device disclosed in PTL 1, the correction period for the threshold voltage Vth of the drive transistor is under 2 H, and thus there is a limitation for a display device in which precise correction is required.

However, in the conventional technique, there is the problem that the signal output load on the scanning line drive circuit and the power supply line drive circuit increases as the area of the display Panel increases, and the problem that precise correction is difficult because the threshold voltage correction period is short.

In order to solve the aforementioned problems, a display device according to an exemplary embodiment disclosed herein is a display device display device including pixels arranged in rows and columns, the display device including: a first signal line and a second signal line which are disposed in each of the columns, for supplying the pixels with a signal voltage that determines luminance of the pixels; a first power source line and a second power source line; a scanning line disposed in each of the rows; and a first control line and a second control line which are disposed in each of the rows, wherein the pixels compose at least two driving blocks each of which includes at least two of the rows, each of the pixels includes: a light-emitting element that includes terminals, one of the terminals being connected to the second power source line, the light-emitting element emitting light according to a flow of a signal current corresponding to the signal voltage; a drive transistor that includes a gate, a source, and a drain and converts the signal voltage applied between the gate and the source of the drive transistor into the signal current, one of the source and the drain being connected to the first power source line; a first capacitive element that includes terminals, one of the terminals being connected to the gate of the drive transistor; a second capacitive element that includes terminals, one of the terminals being connected to the one or the other of the terminals of the first capacitive element, and the other of the terminals being connected to the source of the drive transistor; a first switching transistor that includes a gate connected to the second control line, one of a source and a drain connected to the gate of the drive transistor, and the other of the source and the drain connected to the drain of the drive transistor; and a second switching transistor that includes a gate connected to the first control line, and a source and a drain which are arranged between the other of the source and the drain of the drive transistor and the other of the terminals of the light-emitting element, each of the pixels in a kth drive block of the drive blocks further includes a third switching transistor that includes a gate connected to the scanning line, one of a source and a drain connected to the first signal line, and the other of the source and the drain connected to the other of the terminals of the first capacitive element, k being a positive integer, each of the pixels in a (k+1)th drive block of the drive blocks further includes a fourth switching transistor that includes a gate connected to the scanning line, one of a source and a drain connected to the second signal line, and the other of the source and the drain connected to the other of the terminals of the first capacitive element, and the second control line is connected to the pixels in a same one of the drive blocks and not connected to the pixels in different ones of the drive blocks.

Accordingly, the drive transistor initialization periods as well as the threshold voltage correction periods can be made uniform within the drive block by way of (i) the pixel circuits that are each provided with: the first switching transistor provided between the gate and drain of the drive transistor; the second switching transistor that connects the current path from the drive transistor to the pixel; and the first capacitive element and the second capacitive element, and (ii) the arrangement of control lines, scanning lines, and signal lines to the respective pixels which are grouped into drive blocks. Therefore, the load on the drive circuit which outputs signals for controlling current paths, and controls signal voltages is reduced. In addition, through the above-described forming of drive blocks and the two signal lines arranged for every pixel column, the drive transistor threshold voltage correction period can take a large part of a 1-frame period Tf which is the time in which all the pixels are refreshed. This is because the threshold voltage correction period is provided in the (k+1)th drive block in the period in which the luminance signal voltage is sampled in the kth drive block. Therefore, the threshold voltage correction period is not divided on a per pixel row basis, but is divided on a per drive block basis. Therefore, as the display area is increased, a long relative threshold voltage correction period can be set with respect to 1 frame period, without allowing light emission duty to decrease with the increase in the display area. With this, a drive current based on luminance signal voltage that has been corrected with a high degree of precision flows to the light-emitting elements, and thus image display quality improves.

For example, the first control line may be connected to the pixels in a same one of the drive blocks and not connected to the pixels in different ones of the drive blocks.

Accordingly, by controlling the second switching transistors connecting the current path from the drive transistor to the pixel, simultaneously within the same drive block using the first control line, simultaneous emission of light within the same drive block can be realized. In addition, the load on the drive circuit that outputs, to the first control line, the signals for controlling the second switching transistors is reduced.

For example, the display device may further include a drive circuit that drives each of the pixels by controlling the first signal line, the second signal line, the first control line, the second control line, and the scanning line, wherein the drive circuit: simultaneously applies an initializing voltage to the gate of the drive transistor of each of the pixels in the kth drive block by turning ON the third switching transistor using a scanning signal from the scanning line and turning ON the first switching transistor of each of the pixels in the kth drive block using a control signal from the second control line, in a state in which the second switching transistor is turned ON using a control signal from the first control line, the initializing voltage causing a gate-source voltage of the drive transistor to be higher than or equal to the threshold voltage of the drive transistor; simultaneously turns OFF the second switching transistor of each of the pixels in the kth drive block, in a state in which the first switching transistor and the third switching transistor are ON; simultaneously applies the initializing voltage to the gate of the drive transistor of each of the pixels in the (k+1)th drive block by turning ON the fourth switching transistor using a scanning signal from the scanning line and turning ON the first switching transistor of each of the pixels in the (k+1)th drive block using a control signal from the second control line, in a state in which the second switching transistor is turned ON using a control signal from the first control line; and simultaneously turns OFF the second switching transistor of each of the pixels in the (k+1)th drive block, in a state in which the first switching transistor and the fourth switching transistor are ON.

Accordingly, the drive circuit controlling the voltages the first signal lines, the second signal lines, the first control lines, the second control lines, and the scanning lines controls the threshold correction period, signal voltage writing period, and light-emitting period.

For example, the signal voltage may include the luminance signal voltage and a reference voltage for causing a voltage corresponding to the threshold voltage of the drive transistor to be stored in the first capacitive element and the second capacitive element, the display device may further include: a signal line drive circuit that outputs the signal voltage to the first signal line and the second signal line; and a timing control circuit that controls a timing at which the signal line drive circuit outputs the signal voltage, and the timing control circuit may (i) cause the signal line drive circuit to output the reference voltage to the second signal line when the signal line drive circuit is outputting the luminance signal voltage to the first signal line, and (ii) cause the signal line drive circuit to output the reference voltage to the first signal line when the signal line drive circuit is outputting the luminance signal voltage to the second signal line.

Accordingly, the threshold voltage correction period is provided in the (k+1)th drive block, in the period in which the luminance signal voltage is sampled in the kth drive block. Therefore, the threshold voltage correction period is not divided on a per pixel row basis, but is divided on a per drive block basis. Therefore, a longer relative threshold voltage correction period with respect to 1 frame period can be set as the display area is increased.

For example, where a period of time for refreshing all of the pixels is Tf, and a total number of the drive blocks is N, a period of time for detecting the threshold voltage of the drive transistor may be at most Tf/N.

Furthermore, these general and specific aspects can be implemented, not only as a display device including such characteristic units, but also as display device driving method having the characteristic units included in the display device as steps.

These general and specific aspects may be implemented using a system, a method, an integrated circuit, a computer program, or a computer-readable recording medium such as a CD-ROM, or any combination of systems, methods, integrated circuits, computer programs, or computer-readable recording media.

Hereinafter, certain exemplary embodiments are described in greater detail with reference to the accompanying Drawings.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of the appended Claims and their equivalents. Therefore, among the structural elements in the following exemplary embodiments, structural elements not recited in any one of the independent claims are described as arbitrary structural elements.

Embodiment 1

A display device according to this embodiment is a display device including pixels arranged in rows and columns, the display device including: a first signal line and a second signal line which are disposed in each of pixel columns; and a first control line and a second control line which are disposed in each of pixel rows, wherein the pixels compose at least two driving blocks each of which includes at least two of the pixel rows, each of the pixels includes: a light-emitting element that emits light according to a flow of a signal current corresponding to the signal voltage; a drive transistor that converts the signal voltage applied between the gate and source thereof into the signal current; a first capacitive element having one terminal connected to the gate of the drive transistor; a second capacitive element having one terminal to other terminal of the first capacitive element; a first switching transistor that is provided between the gate and drain of the drive transistor, and turns ON and OFF according to a control signal from the second control line; and a second switching transistor that is provided between the drain of the drive transistor and the light-emitting element, and turns ON and OFF according to a control signal from the first control line, each of the pixels in an odd drive block further includes a third switching transistor provided between the first signal line and the gate of the drive transistor, each of the pixels in an even drive block further includes a fourth switching transistor provided between the second signal line and the gate of the drive transistor, and each of the first control line and the second control line is connected to the pixels in a same one of the drive blocks and not connected to the pixels in different ones of the drive blocks.

With this, the drive transistor threshold voltage correction periods as well as the light-emitting periods can be made uniform within the drive block. Therefore, the load on the drive circuit is decreased. Furthermore, since a long threshold voltage correction period can be taken with respect to one frame period, image display quality is improved.

Hereinafter, an embodiment in the present disclosure shall be described with reference to the Drawings.

FIG. 1 is a block diagram showing the electrical configuration of a display device according to Embodiment 1 in the present disclosure. A display device 1 in the figure includes a display panel 10, a timing control circuit 20, and a voltage control circuit 30. The display panel 10 includes the pixels 11A and 11B, a signal line group 12, a control line group 13, a scanning/control line drive circuit 14, and a signal line drive circuit 15.

The pixels 11A and 11B are arranged in a matrix on the display panel 10. Here, the pixels 11A and 11B compose two or more drive blocks each of which is one drive block made up of plural pixel rows. The pixels 11A compose a kth drive block (k is a positive integer) and the pixels 11B compose a (k+1)th drive block. However, in the case where the display panel 10 is divided into N drive blocks, (k+1) is a positive integer less than or equal to N. This means that, for example, the pixels 11A compose odd drive blocks and the pixels 11B compose even drive blocks. In the subsequent Embodiments 1 to 3, a kth drive block and a (k+1)th drive block are exemplified as an odd block and an even block respectively.

The signal line group 12 includes plural signal lines disposed in each of the pixel columns. Here, two signal lines are disposed in each of the pixel columns, the pixels of odd drive blocks are connected to a first signal line, and the pixels of even drive blocks are connected to a second signal line different from the first signal line.

The control line group 13 includes scanning lines and control lines, with each of the scanning lines and each of the control lines disposed on a per pixel basis.

The scanning/control line drive circuit 14 drives the circuit element of each pixel by outputting a scanning signal to the respective scanning lines of the control line group 13 and outputting a control signal to the respective control lines of the control line group 13.

The signal line drive circuit 15 drives the circuit element of each pixel by outputting a luminance signal or a reference signal to the respective signal lines of the signal line group 12. Stated differently, the signal line drive circuit 15 outputs a signal voltage indicated by a luminance signal and a reference signal to the respective signal lines. The luminance signal is a voltage for causing the light-emitting element to emit light, and is specifically a voltage corresponding to the luminance of the light-emitting element. The reference signal is a voltage for causing the voltage corresponding to threshold voltage of the drive transistor to be stored in the first capacitive element and the second capacitive element. It should be noted that there are instances where the luminance signal is called a luminance signal voltage and the reference signal is called a reference voltage.

The timing control circuit 20 controls the output timing of scanning signals and control signals outputted from the scanning/control line drive circuit 14. Furthermore, the timing control circuit 20 controls the timing for the outputting of luminance signals or reference signals outputted to the first signal line and the second signal line from the signal line drive circuit 15. The timing control circuit 20 causes the signal line drive circuit 15 to output the reference voltage to the second signal line while causing the outputting of the luminance signal to the first signal line, and causes the signal line drive circuit 15 to output the reference voltage to the first signal line while causing the outputting of the luminance signal to the second signal line.

The voltage control circuit 30 controls the voltage level of the scanning signals and the control signals outputted from the scanning/control line drive circuit 14. It should be noted that the scanning/control line drive circuit 14, the signal line drive circuit 15, the timing control circuit 20, and the voltage control circuit 30 correspond to the drive circuit in the present disclosure.

Figure 2A:
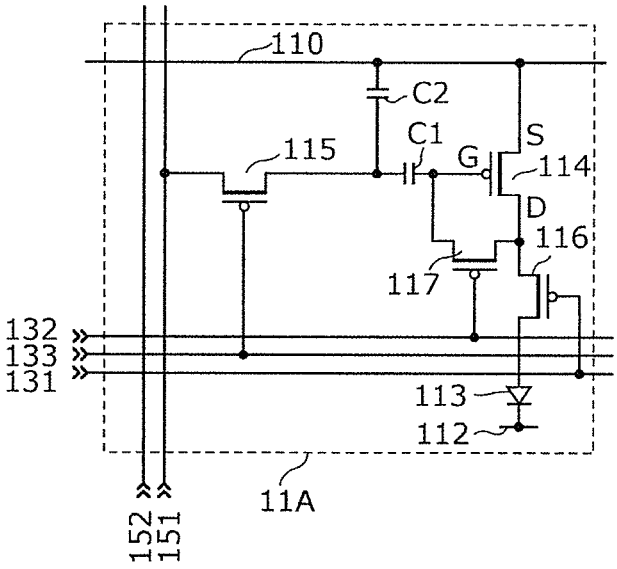
FIG. 2 A is a specific circuit configuration diagram of a pixel of an odd drive block in the display device according to Embodiment 1 in the present disclosure.
Figure 2B:
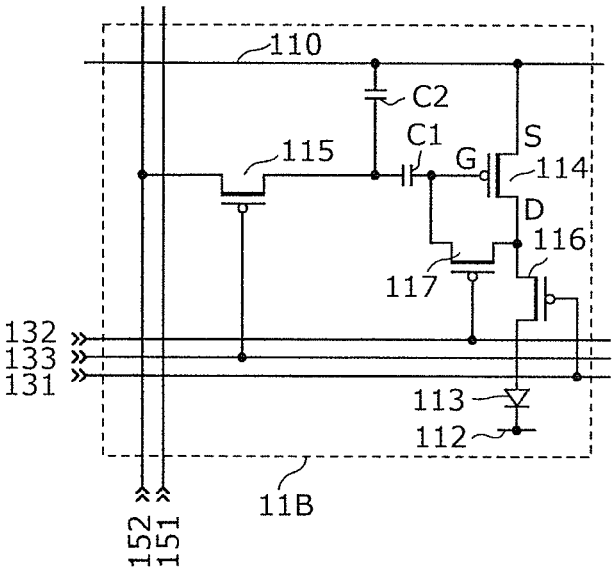

FIG. 2 A is a specific circuit configuration diagram of a pixel of an odd drive block in the display device according to Embodiment 1 in the present disclosure, and FIG. 2 B is a specific circuit configuration diagram of a pixel of an even drive block in the display device according to Embodiment 1 in the present disclosure. Each of the pixels 11A and 11B shown in FIG. 2A and FIG. 2B, respectively, include: an organic electroluminescence (EL) element 113; a drive transistor 114; electrostatic storing capacitors C1 and C2; switching transistors 115, 116, and 117; a first control line 131; a second control line 132; a scanning line 133; a first signal line 151; and a second signal line 152.

In FIG. 2A and FIG. 2B, the organic EL element 113 is a light-emitting element having a cathode connected to the power source line 112 and an anode connected to the drain of the drive transistor 114 via the switching transistor 116. The organic EL element 113 emits light according to the flow of the drive current of the drive transistor 114.

The drive transistor 114 has a source connected to the power source line 110 which is a positive power source line, and a drain connected to the anode of the organic EL element 113 via the switching transistor 116. The drive transistor 114 converts a signal voltage applied between the gate and source into a drain current corresponding to such signal voltage. Subsequently, the drive transistor 114 supplies this drain current, as a drive current, to the organic EL element 113. The drive transistor 114 is configured of a P-type thin film transistor (TFT).

The electrostatic storing capacitor C1, which corresponds to the first capacitive element in the present disclosure, has one of terminals connected to the gate of the drive transistor 114 and the other of the terminals connected to the first signal line 151 or the second signal line 152 via the switching transistor 115.

The electrostatic storing capacitor C2, which corresponds to the second capacitive element in the present disclosure, has one of terminals connected to the other of the terminals of the electrostatic storing capacitor C1 and the other of the terminals connected to the source of the drive transistor 114. In other words, the other of the terminals of the electrostatic storing capacitor C2 is connected to the power source line 110.

The luminance signal voltage for causing the organic EL element 113 to emit light and the threshold voltage of the drive transistor 114 are stored in the electrostatic storing capacitors C1 and C2. Specifically, the electrostatic storing capacitor C1 stores a voltage corresponding to the threshold voltage of the drive transistor 114. Subsequently, even when the luminance signal voltage is applied from the first signal line 151 or the second signal line 152 via the switching transistor 115 and the luminance signal voltage is stored in the electrostatic storing capacitor C2, the voltage corresponding to the threshold voltage stored in the electrostatic storing capacitor C1 is still stored in the electrostatic storing capacitor C2. Therefore, when the luminance signal voltage is applied, the voltage stored in the electrostatic storing capacitors C1 and C2 becomes a voltage corresponding to a luminance signal voltage corrected by the threshold voltage of the drive transistor 114.

The switching transistor 115 has a gate connected to the scanning line 133, one of a source and a drain connected to the first signal line 151 or the second signal line 152, and the other of the source and the drain to the other of the terminals of the electrostatic storing capacitor C1.

Here, the switching transistor 115 included in a pixel 11A of an odd block corresponds to the third switching transistor in the present disclosure, and the other of the source and the drain of such switching transistor 115 is connected to the first signal line 151. On the other hand, the switching transistor 115 included in a pixel 11B of an even block corresponds to the fourth switching transistor in the present disclosure, and the other of the source and the drain of such switching transistor 115 is connected to the first signal line 152.

The switching transistor 116, which corresponds to the second switching transistor in the present disclosure, has a gate connected to the first control line 131, a source and a drain arranged between the drain of the drive transistor 114 and the anode of the organic EL element 113. The switching transistor 116 switches between conduction and non-conduction between the drive transistor 114 and the anode of the organic EL element 113, according to a control signal from the first control line 131. In other words, the switching transistor controls the supply of drive current to the organic EL element 113.

The switching transistor 117, which corresponds to the first switching transistor in the present disclosure, has a gate connected to the second control line 132, one of a source and a drain connected to the gate of the drive transistor 114, and the other of the source and the drain connected to the drain of the drive transistor 114. The switching transistor 117 switches between conduction and non-conduction between the gate and drain of the drive transistor 114, according to a control signal from the second control line 132. Specifically, the switching transistor 117 turns ON in a resetting period, which is a period for performing an initialization operation for detecting the threshold voltage prior to a threshold voltage detecting period, thereby switching to conduction between the gate and drain of the drive transistor 114, and set the voltage of the gate of the drive transistor 114 to an initializing voltage VR2 with which the gate-source voltage of the drive transistor 114 becomes greater than or equal to the threshold voltage. In addition, the switching transistor 117 turns ON in the threshold voltage detection period, thereby causing a voltage corresponding to the threshold voltage to be stored in the electrostatic storing capacitor C1.

The switching transistors 115, 116, and 117 are each configured of a P-type thin film transistor (P-type TFT).

The first control line 131 is connected to the scanning/control line drive circuit 14, and is connected to the respective pixels belonging to the pixel row including the pixels 11A or 11B. With this, the first control line 131 has a function of controlling the timing for supplying the drain current of the drive transistor 114 to the organic EL element 113.

The second control line 132 is connected to the scanning/control line drive circuit 14, and is connected to the respective pixels belonging to the pixel row including the pixels 11A or 11B. With this, the second control line 132 has a function of adjusting the environment for detecting the threshold voltage of the drive transistor 114. Stated differently, the second control line 132 controls the timing for setting the voltage of the gate of the drive transistor 114 to an initializing voltage (VR2) with which the gate-source voltage of the drive transistor 114 becomes greater than or equal to the threshold voltage.

The scanning line 133 has a function of supplying the respective pixels belonging to the pixel row including the pixels 11A or 11B with the timing for writing a signal voltage which is the luminance signal voltage or the reference voltage.

Each of the first signal line 151 and the second signal line 152 is connected to the signal line drive circuit 15 and the respective pixels belonging to the pixel column including the pixel 11A or 11B, and has a function of supplying: the reference voltage for detecting the threshold voltage of the drive TFT; and the luminance signal voltage which determines light-emitting intensity.

It should be noted that, although not shown in FIG. 2A to FIG. 2B, each of the power source line 110 and the power source line 112 is also connected to other light-emitting pixels, and to a voltage source. Furthermore, the power source line 110 corresponds to the first power source line in the present disclosure, and the power source line 112 corresponds to the second power source line in the present disclosure.

Next, the inter-pixel connection relationship of the first control line 131, the second control line 132, the scanning line 133, the first signal line 151, and the second signal line 152 shall be described.

Figure 3:
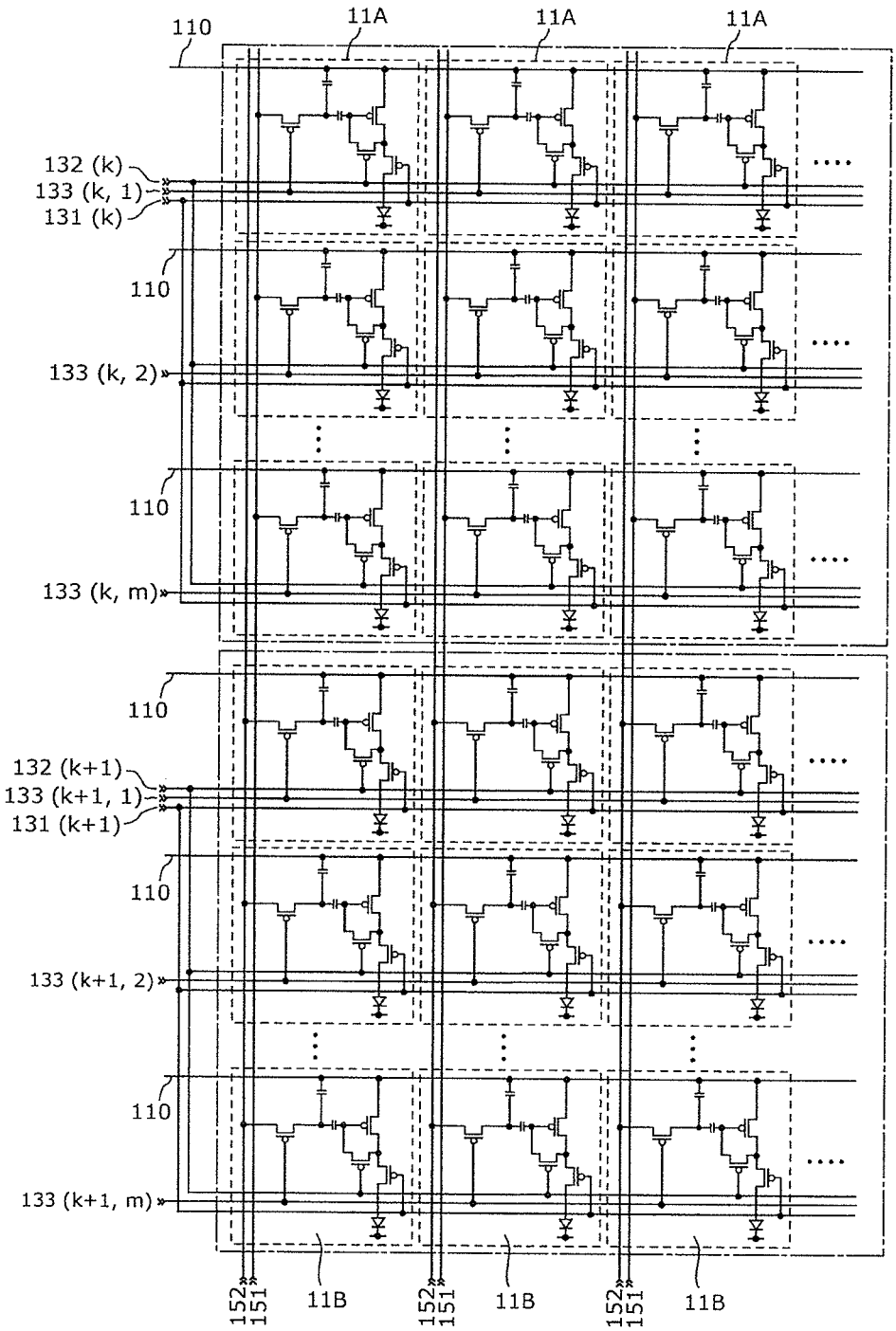
FIG. 3 is a circuit configuration diagram showing part of a display panel included in the display device according to Embodiment 1 in the present disclosure.

FIG. 3 is a circuit configuration diagram showing part of the display panel included in the display device according to Embodiment 1 in the present disclosure. The figure shows two adjacent drive blocks and respective control lines, respective scanning lines, and respective signal lines. In the figure and the subsequent description, the respective control lines, respective scanning lines, and respective signal lines shall be represented by "reference number (block number; row number of the block)" or "reference number (block number)".

As previously described, a drive block includes plural pixel rows, and there are two or more drive blocks within the display panel 10. For example, each of the drive blocks shown in FIG. 3 includes m rows of pixel rows.

In the kth drive block shown at the top stage of FIG. 3, the first control line 131 (*k*) is connected in common to the gates of the respective switching transistors 116 included in all the pixels 11A in the drive block. Furthermore, the second control line 132 (*k*) is connected in common to the gates of the respective switching transistors 117 included in all the pixels 11A in the drive block. On the other hand, each of the scanning lines 133 (*k*, 1) to 133 (*k, m*) are separately connected on a per pixel row basis. Specifically, the first control line 131 is connected to the scanning/control line drive circuit 14, and is connected to the respective pixels belonging to the pixel row including the pixels 11A or 1113.

Furthermore, the same connections as those in the kth drive block are also carried out on the (k+1)th drive block shown in the bottom stage of FIG. 3. However, the first control line 131 (*k*) connected to the kth drive block and the first control line 131 (*k*+1) connected to the (k+1)th drive block are different control lines, and separate control signals are outputted from the scanning/control line drive circuit 14. Furthermore, the second control line 132 (*k*) connected to the kth drive block and the second control line 132 (*k*+1) connected to the (k+1)th drive block are different control lines, and separate control signals are outputted from the scanning/control line drive circuit 14. Specifically, the first control lines 131 and the second control lines 132 are shared by all of the pixels in a same one of the drive blocks, and are independent of another between different ones of the drive blocks.

Here, control lines are shared in the same one of the drive blocks means that a single control signal outputted from the scanning/control line drive circuit 14 is simultaneously supplied to the control lines in the same one of the drive blocks. For example, in the same one of the drive blocks, a single control line connected to the scanning/control line drive circuit 14 branches out to the first control lines 131 which are disposed on a per pixel row basis. Furthermore, the control lines are independent between different drive blocks means that separate control signals outputted from the scanning/control line drive circuit 14 are supplied to the plural drive blocks. For example, the first control lines 131 are individually connected to the scanning/control line drive circuit 14 on a per drive block basis.

Furthermore, in the kth drive block, the first signal line 151 is connected to the other of the source and drain of the respective switching transistors 115 included in all of the pixels 11A in the drive block. Meanwhile, in the (k+1)th drive block, the second signal line 152 is connected to the other of the source and drain of the respective switching transistors 115 included in all of the pixels 11B in the drive block.

With the grouping into drive blocks, the number of first control lines 131 for controlling the connection between the organic EL elements 113 and the drain of the drive transistors 114 is reduced. Furthermore, the number of second control lines 132 for switching to conduction between the gate and drain of the drive transistor 114, in the resetting period, which is a period for setting the gate voltage of the drive transistor 114 to the initializing voltage (VR2) is reduced. Therefore, the number of outputs of the scanning/control line drive circuit 14 which outputs drive signals to these control lines is reduced, thus allowing a reduction in circuit size.

Figure 4A:
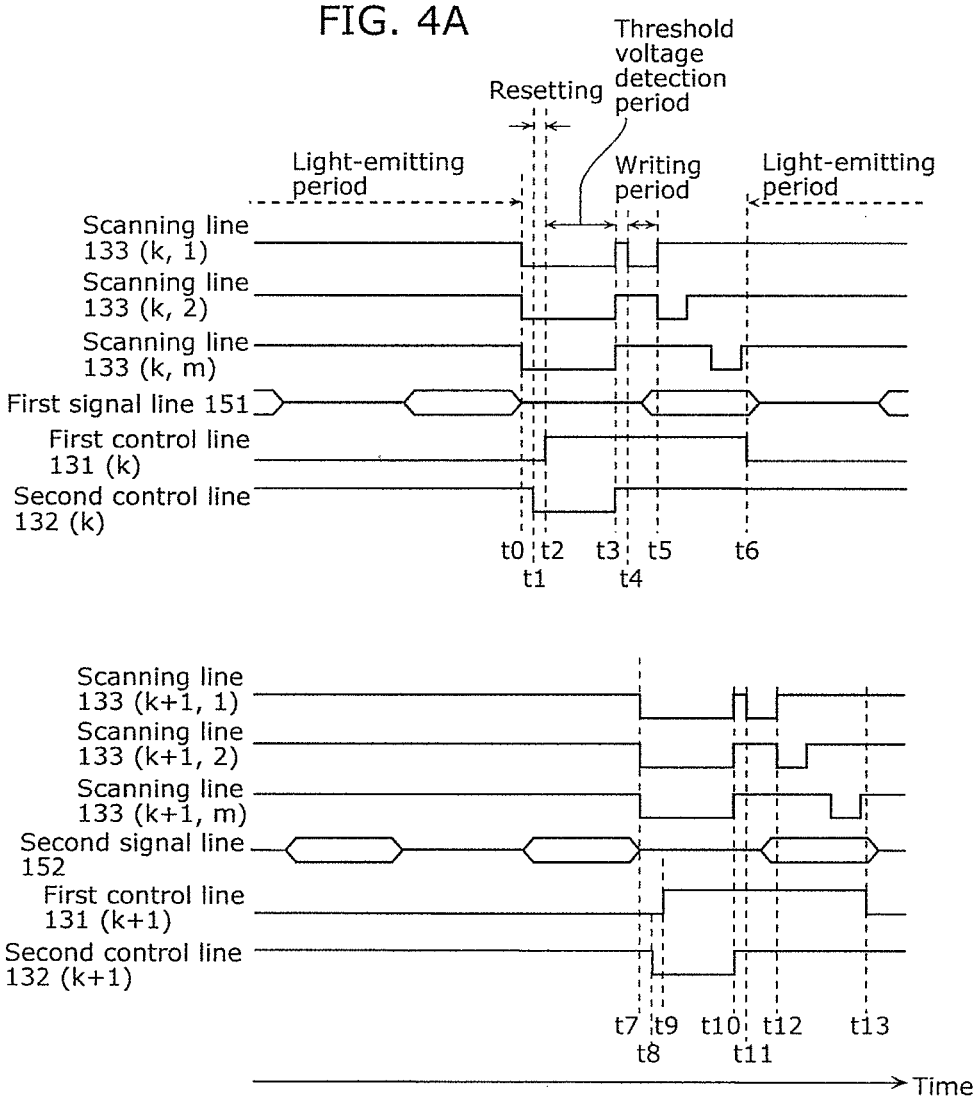
FIG. 4A is an operation timing chart for a driving method of the display device according to the Embodiment 1 in the present disclosure.

Next, the driving method of the display device 1 according to this embodiment shall be described using FIG. 4A. It should be noted that, here, the driving method of the display device including the specific circuit configuration shown in FIG. 2A and FIG. 2B shall be described in detail.

Figure 5:
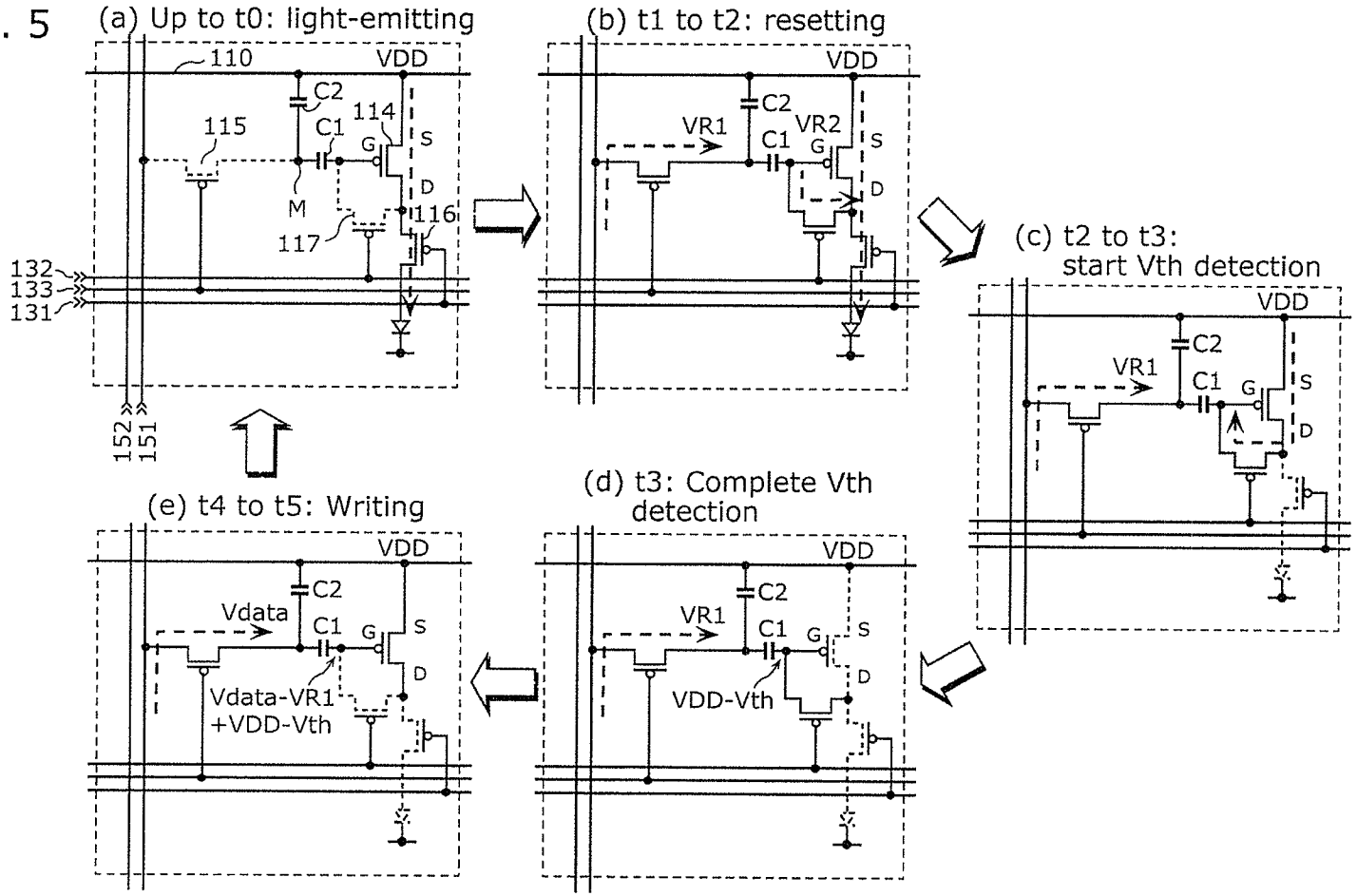
FIG. 5 is a state transition diagram for a pixel included in the display device according to Embodiment 1 in the present disclosure.

FIG. 4A is an operation timing chart for the driving method of the display device according to Embodiment 1 in the present disclosure. In the figure, the horizontal axis denotes time. Furthermore, in the vertical direction, the waveform diagrams of the voltage generated in the scanning lines 133 (*k*, 1), 133 (*k*, 2), and 133 (*k*, m), the first signal line 151, the first control line 131 (*k*), and the second control line 132 (*k*) of the kth drive block are shown in sequence from the top. Furthermore, continuing therefrom, the waveform diagrams of the voltage generated in the scanning lines 133 (*k*+1, 1), 133 (*k*+1, 2), and 133 (*k*+1, m), the second signal line 152, the first control line 131 (*k*+1), and the second control line 132 (*k*+1) of the (k+1)th drive block are shown. Furthermore, FIG. 5 is a state transition diagram for a pixel included in the display device according to Embodiment 1 in the present disclosure. Furthermore, FIG. 6 is an operation flowchart for the display device according to the Embodiment 1 in the present disclosure.

First, immediately before a time t0, the voltage levels of the scanning lines 133 (*k*, 1) to 133 (*k, m*) are all HIGH, the voltage level of the first control line 131 (*k*) is LOW, and the voltage level of the second control line 132 (*k*) is also HIGH. Specifically, a voltage corresponding to the total of the threshold voltage of the drive transistor 114 and the luminance signal voltage in the immediately preceding frame period is stored in the electrostatic storing capacitors C1 and C2, and the organic EL element 113 emits light at a luminance that is in accordance with the voltage stored in the electrostatic storing capacitors C1 and C2.

Next, at a time t0, the scanning/control line drive circuit 14 causes the voltage levels of the scanning lines 133 (*k*, 1) to 133 (*k, m*) to simultaneously change from HIGH to LOW so as to turn ON the switching transistor 115. At this time, voltage control circuit 30 causes the signal voltage of the first signal line 151 to change form the luminance signal voltage to the reference signal voltage. Therefore, when the reference voltage is VR1, at the time t0, the voltage at a voltage-dividing point M, which is the connection point of the electrostatic storing capacitor C1 and the electrostatic storing capacitor C2, is VR1. Specifically, the reference voltage of the first signal line 151 is applied to the voltage-dividing point M (step S11 in FIG. 6). At this time, a flow-through current starts to flow from the power source line 110 to the power source line 112.

Figure 6:
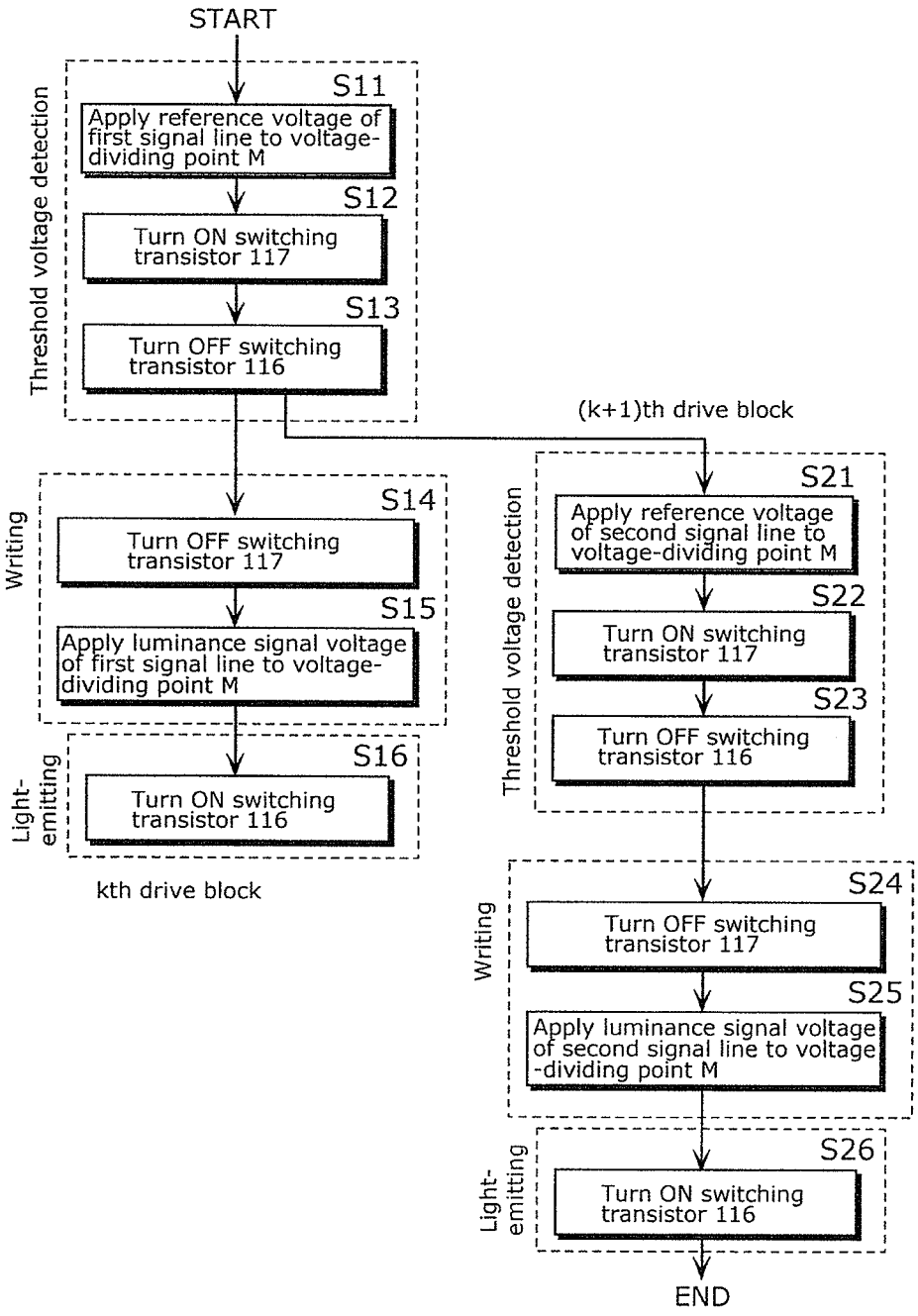
FIG. 6 is an operation flowchart for the display device according to Embodiment 1 in the present disclosure.

Next, at a time t1, the scanning/control line drive circuit 14 causes the voltage level of the second control line 132 (*k*) to change from HIGH to LOW to turn ON the respective switching transistors 117 included in all of the pixels 11A belonging to the kth drive block (step S12 in FIG. 6). Accordingly, together with the flow-through current flowing from the power source line 110 to the power source line 112, a current flows from the gate of the drive transistor 114 to the power source line 112 via the switching transistor 117. As a result, the gate voltage of the drive transistor 114 is reset to the initializing voltage (VR2) with which the gate-source voltage of the drive transistor 114 becomes greater than or equal to the threshold voltage. Stated differently, the gate-source voltage of the drive transistor 114 is set to the potential difference which allows for detection of the threshold voltage of the drive transistor 114, and the preparation for the threshold voltage detection process is completed.

Specifically, the period from the time t1 to the time t2 and steps S11 and S12 in FIG. 6 correspond to the applying of the initializing voltage in the kth drive block in the present disclosure.

Next, at a time t2, the scanning/control line drive circuit 14 causes the voltage level of the first control line 131 (*k*) to change from LOW to HIGH to turn OFF the respective switching transistors 116 included in all of the pixels 11A belonging to the kth drive block (step S13 in FIG. 6). At this time, as shown in (c) in FIG. 5, the drive transistor 114 is continuously ON, and thus the drain current of the drive transistor 114 flows from the drain of the drive transistor 114 to the gate of the drive transistor 114. As a result, the voltage level of the gate of the drive transistor 114 becomes asymptotic to VDD−Vth which is a voltage that is lower than the voltage level (VDD) of the source of the drive transistor 114 by the threshold voltage (Vth).

Then, as shown in (d) in FIG. 5, when the voltage level of the gate of the drive transistor 114 a voltage level that is lower than the power source voltage (VDD) of the power source line 110 by the threshold voltage Vth of the drive transistor 114, the flow of the drain current stops. At this time, when the voltage level of the gate of the drive transistor 114 is Vg, Vg can be expressed as follows.

$$Vg=VDD-Vth \quad \text{(Expression 1)}$$

Here, the reference voltage (VR1) supplied from the first signal line 151 is applied to the one of the terminals of the electrostatic storing capacitor C1, and the voltage level of the other of the terminals of the electrostatic storing capacitors C2 becomes VDD−Vth which is equivalent to the voltage level of the gate of the drive transistor 114. Specifically, a voltage VC1 stored in the electrostatic storing capacitor C1 can be expressed as follows.

$$VC1=VDD-Vth-VR1 \quad \text{(Expression 2)}$$

In other words, the voltage VC1 stored in the electrostatic storing capacitor C1 is a voltage corresponding to the threshold voltage.

It should be noted that, since the flowing current for causing the voltage level of the gate of the drive transistor 114 to asymptotically approach VDD−Vth becomes minute with time, it takes time for the voltage level of the drive transistor 114 to reach the steady state. Specifically, since the flowing current for causing the voltage corresponding to the threshold voltage Vth to be stored in the electrostatic storing capacitor C1 is minute, reaching the steady state takes time. Therefore, the longer this period is, the more stable the voltage stored in the electrostatic storing capacitor C1 becomes, and by ensuring that this period is sufficiently long, precise voltage compensation is realized.

Here, the period from the time t2 to the time t3 and step S13 in FIG. 6 correspond to the causing of the non-conduction in the kth drive block in the present disclosure. Furthermore, each of the period from the time t1 to the time t3 and steps S11 to S13 in FIG. 6 correspond to the storing of the voltage in the kth drive block in the present disclosure.

Next, at the time t3, the scanning/control line drive circuit 14 causes the voltage level of the second control line 132 (*k*) to change from LOW to HIGH to simultaneously turn OFF the respective switching transistors 117 included in all the pixels 11A belonging to the kth drive block (step S14 in FIG. 6). This completes the threshold voltage detection operation of the pixels 11A belonging to the kth drive block.

As described thus far, in the period from the time t2 to the time t3, the correction of the threshold voltage Vth of the drive transistor 114 is executed simultaneously in the kth drive block, and a voltage corresponding to the threshold voltage Vth of the drive transistor 114 is stored simultaneously in the respective electrostatic storing capacitors C1 of all the pixels 11A in the kth drive block.

Next, at the time t3, the scanning/control line drive circuit 14 causes the voltage levels of the scanning lines 133 (*k*, 1) to 133 (*k, m*) to simultaneously change from LOW to HIGH to turn ON the switching transistor 115. With this, the supply of the reference voltage VR1 to the voltage-dividing point M is stopped. It should be noted that the timing for causing the voltage levels of the scanning lines 133 (*k*, 1) to 133 (*k, m*) to change from LOW to HIGH is not limited to such, and may be anywhere in a period from the time t3 up to when a luminance signal voltage is supplied from the first signal line 151.

Next, in a period from a time t4 to a time t6, the scanning/control line drive circuit 14 causes the voltage levels of the scanning lines 133 (*k*, 1) to 133 (*k, m*) to sequentially change from LOW to HIGH to sequentially turn ON the switching transistors 115 on a per pixel row basis. Furthermore, at this time, the signal line drive circuit 15 causes the signal voltage of the first signal line 151 to change from the reference voltage VR1 to the luminance signal voltage Vdata. With this, as shown in (e) in FIG. 5, the luminance signal voltage Vdata is applied to the voltage-dividing point (step S15 in FIG. 6). At this time, since the voltage stored in the electrostatic storing capacitor C1 does not change, the voltage level of the gate of the drive transistor 114 only changes by as much as the change in the voltage level of the voltage-dividing point M. Therefore, when the voltage level of the gate of the drive transistor 114 is Vg, Vg can be expressed as follows.

$$Vg=V\text{data}-VR1+VDD-Vth \quad \text{(Expression 3)}$$

In other words, a voltage corresponding to the luminance signal voltage Vdata and the threshold voltage Vth is written into the gate of the drive transistor 114.

Stated differently, when the gate-source voltage of the drive transistor 114 in the case where the voltage level of the source of the drive transistor 114 is taken as a reference is Vgs, Vgs can be expressed as follows.

$$Vgs=V\text{data}-VR1-Vth \quad \text{(Expression 4)}$$

Specifically, for the gate-source voltage Vgs of the drive transistor 114, a luminance signal voltage corrected by the threshold voltage is written. Specifically, a summed voltage obtained by adding a voltage corresponding to the threshold voltage and a voltage corresponding to the luminance signal voltage is stored in the electrostatic storing capacitor C1 and the electrostatic storing capacitor C2 which are arranged between the gate and source of the drive transistor 114.

As described thus far, in a period from the time t4 to the time t6, the writing of the corrected luminance signal voltage is sequentially executed in the kth drive block on a per pixel row basis. Here, the period from the time t4 to the time t6 and steps S14 and S15 in FIG. 6 correspond to the storing of the summed voltage in the kth drive block in the present disclosure.

Next, at the time t6, the scanning/control line drive circuit 14 causes the voltage level of the first control line 131 (*k*) to change from HIGH to LOW. In other words, the respective switching transistors 116 in all of the pixels 11A in the kth drive block are simultaneously turned ON (step S16 in FIG. 6). With this, a drive current corresponding to the summed voltage flows to the organic EL element 113 as shown in (a) in FIG. 5. In other words, light-emission begins simultaneously in all the pixels 11A in the kth drive block.

As described thus far, in a period from the time t6 onward, light-emission by the organic EL elements 113 is executed simultaneously in the kth drive block. Here, the period from the time t6 onward and step S16 in FIG. 6 correspond to the emitting of the light in the kth drive block in the present disclosure.

As described thus far, grouping the pixel rows into drive blocks allows the compensation of the threshold voltage Vth of the drive transistors 114 to be executed simultaneously in the respective drive blocks. Furthermore, the light-emission by the organic EL elements 113 is executed simultaneously in the respective drive blocks. With this, the control for turning the drive current of the drive transistors 114 ON and OFF can be synchronized in the respective drive blocks. Therefore, the first control line 131 and the second control line 132 can be provided in common in each of the drive blocks.

Furthermore, although the scanning lines 133 (*k*, 1) to 133 (*k*, *m*) are separately connected to the scanning/control line drive circuit 14, the timing of the HIGH level period and the LOW level period of the drive pulse (control signal) outputted from the scanning/control line drive circuit 14 in the threshold voltage correction period is the same. Therefore, the scanning/control line drive circuit 14 can suppress the rising of the frequency of the drive pulse to be outputted, and thus the output load on the drive circuit can be reduced.

In contrast, in each of the pixels 11A and 11B included in the display device 1 according to the present disclosure, the switching transistor 117 is connected between the drain and gate of the drive transistor 114, and the switching transistor 116 is connected between the drain of the drive transistor 114 and the organic EL element 113 as previously described. With this, the gate potential with respect to the source potential of the drive transistor 114 is stabilized, and thus the time from the writing of voltage due to threshold voltage correction up to the additional writing of the luminance signal voltage, or the time from the additional writing up to the light-emission can be arbitrarily set on a per pixel row basis. With to this circuit configuration, grouping into drive blocks becomes possible, and the threshold voltage correction periods as well as the light-emitting periods can be made uniform within the same drive block.

Here, the comparison of light emission duty defined according to the threshold voltage detection period is performed between the conventional image display device using two signal lines described in PTL 1 and the display device having the drive blocks according to the present disclosure.

Figure 7:
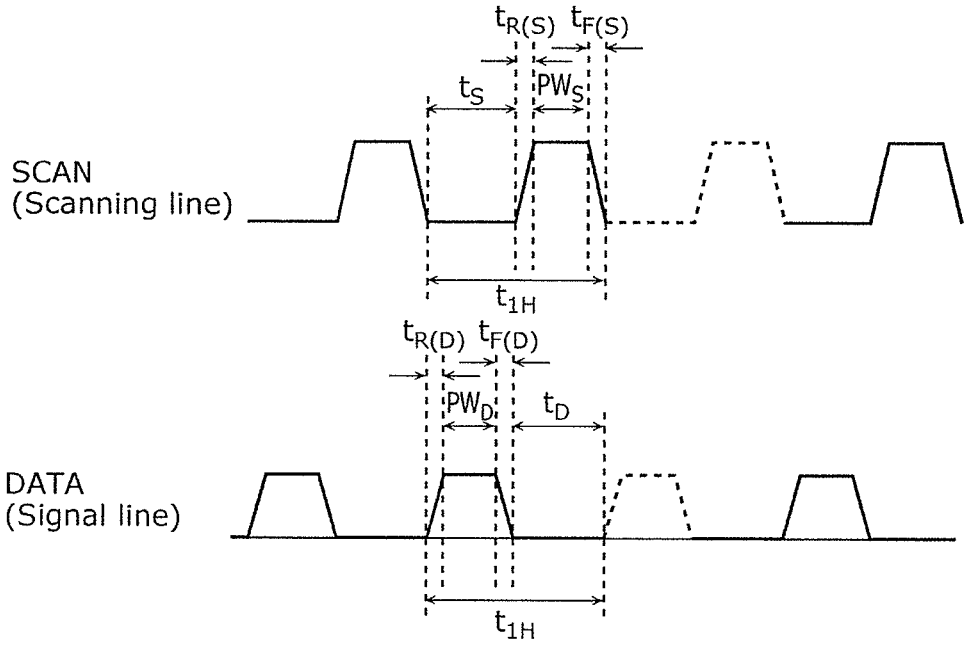
FIG. 7 is a diagram for describing the waveform characteristics of a scanning line and a signal line.

FIG. 7 is a diagram for describing the waveform characteristics of a scanning line and a signal line. In the figure, the period for detecting the threshold voltage Vth in one horizontal period t1H for each pixel row is a period in which the reference voltage is applied to the electrostatic storing capacitor of the respective pixels and is equivalent to PWS which is the period in which the scanning line is at the HIGH level. It should be noted that, in the waveform characteristics of the scanning line shown in FIG. 7, when the switching transistor for connecting the signal line and the electrostatic storing capacitor is of the P-type, the waveform of the scanning line is a waveform in which the HIGH level and the LOW level are inverted. At this time, PWS which is the period for detecting the threshold voltage Vth in one horizontal period t1H for each pixel row is in the LOW level. Furthermore, for a signal line, one horizontal period t1H includes PWD which is a period in which signal voltage is supplied and tD which is a period in which the standard voltage is supplied. Furthermore, assuming the rise time and fall time of PWS to be tR(S) and tF(S), respectively, and the rise time and fall time of PWD to be tR(D) and tF(D), respectively, one horizontal period t1H is expressed as below.

$$t1H=tD+PWD+tR(D)+tF(D) \quad \text{(Expression 5)}$$

In addition, assuming PWD=tD, the subsequent expression is obtained.

$$tD+PWD+tR(D)+tF(D)=2tD+tR(D)+tF(D) \quad \text{(Expression 6)}$$

According to Expression 5 and Expression 6, tD is expressed as below.

$$tD=(t1H-tR(D)-tF(D))/2 \quad \text{(Expression 7)}$$

Furthermore, since the Vth detection period must begin and end within the reference voltage generation period, tD is expressed as below when a maximum Vth detection period is secured.

$$tD=PWS+tR(S)+tF(S) \quad \text{(Expression 8)}$$

According to Expression 7 and Expression 8, the subsequent equation is obtained.

$$PWS=(t1H-tR(D)-tF(D)-2tR(S)-2tF(S))/2 \quad \text{(Expression 9)}$$

With respect to Expression 9, as an example, the light emission duty of a panel having a vertical resolution of 1,080 scanning lines (+30 lines for blanking) and which is driven at 120 Hz shall be compared.

In the conventional image display device, one horizontal period t1H in the case of having two signal lines is twice that of the case of having one signal line, and is thus expressed through the subsequent equation.

$$t1H=\{1\text{ sec.}/(120\text{ Hz}\times 1110\text{ lines})\}\times 2=7.5\ \mu S\times 2=15\ \mu S$$

Here, tR(D)=tF(D)=2 μS and tR(S)=tF(S)=1.5 μS are assumed, and when these are substituted into Expression 9, the resetting period PWS which is the Vth detecting period becomes 2.5 μS.

Here, assuming that 1000 μS is required for a Vth detection period to have sufficient precision, at least 1000 μS/2.5 μS=400 of horizontal period is needed as a non-light-emitting period in the horizontal period required for such Vth detection. Therefore, the light emission duty of the conventional image display device using two signal lines becomes (1110 horizontal period−400 horizontal period)/1110 horizontal period=64% or less.

Next, the light emission duty of the display device having the drive blocks according to the present disclosure shall be calculated. Assuming that 1000 μS is required for a Vth detection period to have sufficient precision as in the above described condition, in the case of block driving, the resetting period+threshold voltage detection period (hereafter denoted as period A) shown in FIG. 4A is equivalent to the aforementioned 1000 μS. In this case, the non-light-emitting period for one frame becomes at least 1000 μS×2=2000 μS since the aforementioned period A and a writing period are included. Therefore, the light emission duty of the display device having the drive blocks according to the present disclosure is (1 frame time−2000 μS)/1 frame time, and by substituting (1 sec./120 Hz) as the 1 frame time, is 76% or less.

According to the above comparison result, compared to the conventional image display device using two signal lines, combining block driving as in the present disclosure ensures a longer light emission duty even when the same threshold detection period is set. Therefore, it is possible to realize a display device that ensures sufficient light-emitting luminance and has long operational life due to reduced output load on drive circuits.

Conversely, it is understood that when the same light emission duty is set to the conventional image display device using two signal lines and the display device combining block driving as in the present disclosure, the display device 1 according to the present disclosure can ensure a longer threshold voltage detection period.

The driving method of the display device 1 according to this embodiment shall be described once again.

Meanwhile, at a time t7, the correction of the threshold voltage of the drive transistors 114 in the (k+1)th drive block begins.

First, immediately before the time t7, the voltage levels of the scanning lines 133 (*k*+1, 1) to 133 (*k*+1, m) are all HIGH, the voltage level of the first control line 131 (*k*+1) is LOW, and the voltage level of the second control line 132 (*k*+1) is HIGH. From the moment that the voltage levels of the scanning lines 133 (*k*+1, 1) to 133 (*k*+1, m) are changed to LOW, the reference voltage is written into the pixels 11B. With this, the organic EL element 113 stops emitting light, and the concurrent light-emission of the pixels in the (k+1)th drive block ends. At this time, the voltage control circuit 30 causes the signal voltage of the second signal line 152 to change from the luminance signal voltage to the reference voltage with which the gate-source voltage of the drive transistor 114 becomes greater than or equal to the threshold voltage. Therefore, when the reference voltage is VR1, at the time t0, the voltage at a voltage-dividing point M, which is the connection point of the electrostatic storing capacitor C1 and the electrostatic storing capacitor C2, is VR1. Specifically, the reference voltage of the first signal line 151 is applied to the voltage-dividing point M (step S21 in FIG. 6).

Next, at a time t8, the scanning/control line drive circuit 14 causes the voltage level of the second control line 132 (*k*) to change from HIGH to LOW to turn ON the respective switching transistors 117 included in all of the pixels 11B belonging to the (k+1)th drive block (step S22 in FIG. 6). Accordingly, together with the flow-through current flowing from the power source line 110 to the power source line 112, a current flows from the gate of the drive transistor 114 to the power source line 112 via the switching transistor 117. As a result, the gate voltage of the drive transistor 114 is reset to the initializing voltage (VR2) with which the gate-source voltage of the drive transistor 114 becomes greater than or equal to the threshold voltage. Stated differently, the gate-source voltage of the drive transistor 114 is set to the potential difference which allows for detection of the threshold voltage of the drive transistor 114, and the preparation for the threshold voltage detection process is completed.

Specifically, the period from the time t8 to a time t9 and steps S21 and S22 in FIG. 6 correspond to the applying of the initializing voltage in the (k+1)th drive block in the present disclosure.

Next, at the time t9, the scanning/control line drive circuit 14 causes the voltage level of the first control line 131 (*k*) to change from LOW to HIGH to turn OFF the respective switching transistors 116 included in all of the pixels 11B belonging to the (k+1)th drive block (step S23 in FIG. 6). As a result, the voltage level of the gate of the drive transistor 114 becomes asymptotic to VDD−Vth which is a voltage that is lower than the voltage level (VDD) of the source of the drive transistor 114 by the threshold voltage (Vth).

Thus, in the period from the time t9 to a time t10, the correction of the threshold voltage Vth of the drive transistor 114 is executed simultaneously in the (k+1)th drive block, and a voltage corresponding to the threshold voltage Vth of the drive transistor 114 is stored simultaneously in the respective electrostatic storing capacitors C1 of all the pixels 11B in the (k+1)th drive block. Specifically, the period from the time t9 to the time t10 and step S23 in FIG. 6 correspond to the causing of the non-conduction in the (k+1)th drive block in the present disclosure. Furthermore, each of the period from the time t8 to the time t10 and steps S21 to S23 in FIG. 6 correspond to the storing of the voltage in the (k+1)th drive block in the present disclosure.

Next, at the time t10, the scanning/control line drive circuit 14 causes the voltage level of the second control line 132 (*k*+1) to change from LOW to HIGH to turn OFF the respective switching transistors 117 included in the pixels 11B belonging to the (k+1)th drive block (S24 in FIG. 6). This completes the threshold voltage detection operation of the pixels 11B belonging to the (k+1)th drive block.

Next, at the time t10, the scanning/control line drive circuit 14 causes the voltage levels of the scanning lines 133 (*k*+1, 1) to 133 (*k*+1, m) to simultaneously change from LOW to HIGH to turn OFF the respective switching transistors 115. With this, the supply of the reference voltage VR1 to the voltage-dividing point M is stopped. It should be noted that the timing for causing the voltage levels of the scanning lines 133 (*k*+1, 1) to 133 (*k*+1, m) to change from LOW to HIGH is not limited to such, and may be anywhere in a period from the time t10 up to when a luminance signal voltage is supplied from the second signal line 152.

Next, in a period from a time t11 and a time t13, the scanning/control line drive circuit 14 causes the voltage levels of the scanning lines 133 (*k*+1, 1) to 133 (*k*+1, m) to sequentially change from HIGH to LOW to HIGH to sequentially turn ON the switching transistors 115 on a per pixel row basis. Furthermore, at this time, the signal line drive circuit 15 causes the signal voltage of the second signal line 152 to change from the reference voltage VR1 to the luminance signal voltage Vdata. Specifically, as shown in (e) in FIG. 5, the luminance signal voltage Vdata is applied to the voltage-dividing point (step S25 in FIG. 6). With this, the gate-source voltage Vgs of the drive transistor 114 in the (k+1)th drive block becomes the voltage expressed by Expression 4. Specifically, a summed voltage obtained by adding a voltage corresponding to the threshold voltage and a voltage corresponding to the luminance signal voltage is stored in the electrostatic storing capacitor C1 and the electrostatic storing capacitor C2 which are arranged between the gate and source of the drive transistor 114.

As described thus far, in the period from the time t11 onward, the writing of the corrected luminance signal voltage is sequentially executed in the (k+1)th drive block on a per pixel row basis. Specifically, each of the period from the time t11 to the time t12 and steps S24 and S25 in FIG. 6 correspond to the storing of the summed voltage in the (k+1)th drive block.

Next, from the time t13 onward, the scanning/control line drive circuit 14 causes the voltage level of the first control line 131 (*k*+1) to change from HIGH to LOW. In other words, the respective switching transistors 116 in all of the pixels 11B in the (k+1)th drive block are simultaneously turned ON (step S26 in FIG. 6). With this, a drive current corresponding to the aforementioned summed voltage flows to the organic EL element 113. In other words, light emission begins concurrently in all the pixels 11B in the (k+1)th drive block.

As described thus far, in a period from the time t13 onward, the light emission by the organic EL elements 113 is executed simultaneously in the (k+1)th drive block. Specifically, each of the period from the time t13 onward and step S26 in FIG. 6 correspond to the emitting of the light in the (k+1)th drive block.

The operations described thus far are also executed sequentially in the (k+2)th drive block onward in the display panel 10.

Figure 4B:
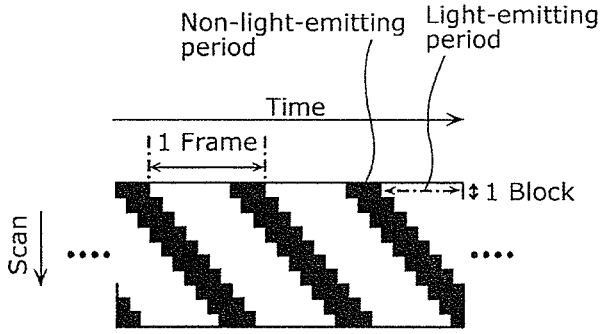
FIG. 4B is a state transition diagram of a drive block which emits light according to the driving method according to Embodiment 1 in the present disclosure.

FIG. 4B is a state transition diagram of a drive block which emits light according to the driving method according to the Embodiment 1 in the present disclosure. In the figure, the light-emitting periods and the non-light-emitting periods of each drive block in a certain pixel column are shown. Plural drive blocks are shown in the vertical direction, and the horizontal axis shows time. Here, a non-light-emitting period is a period in which the pixels 11A and 11B emit light according to a voltage other than the voltage corresponding to the luminance signal voltage supplied from the first signal line 151 or the second signal line 152, and includes the above-described threshold voltage correction period and the luminance signal voltage writing period.

According to the driving method of the display device according to Embodiment 1 in the present disclosure, light-emitting periods are concurrently set in the same drive block. Therefore, among the drive blocks, the light-emitting periods appear in a staircase pattern with respect to the row scanning direction.

As described thus far, the drive transistor 114 threshold voltage correction periods as well as the timings thereof can be made uniform within the same drive block through the pixel circuits in which the switching transistors 116 and 117 and the electrostatic storing capacitors C1 and C2 are provided, the disposition of the control lines, scanning lines, and signal lines to the respective pixels that are grouped into drive blocks, and the above-described driving method. In addition, the light-emitting periods as well as the timings thereof can be made uniform within the same drive block. Therefore, the load on the scanning/control line drive circuit 14 which outputs signals for controlling the conduction and non-conduction of respective switch elements and signals for controlling current paths, and on the signal line drive circuit 15 which controls signal voltages is decreased. In addition, through the above-described grouping into drive blocks and the two signal lines arranged for every pixel column, the threshold voltage correction period of the drive transistor 114 can occupy a large part of a 1-frame period Tf which is the time in which all the pixels are refreshed. This is because the threshold voltage correction period is provided in the (k+1)th drive block in the period in which the luminance signal is sampled in the kth drive block. Therefore, the threshold voltage correction period is not divided on a per pixel row basis, but is divided on a per drive block basis. Thus, even when the display area is increased, a long relative threshold voltage correction period with respect to a 1-frame period can be set without a significant increase in the number of outputs of the scanning/control line drive circuit 14 and without reducing light emission duty. With this, a drive current based on luminance signal voltage that has been corrected with a high degree of precision flows to the light-emitting elements, and thus display quality improves.

For example, in the case where the display panel 10 is divided into N drive blocks, the threshold voltage correction period allocated to each pixel is at most Tf/N. It should be noted that the threshold voltage correction period is a period obtained by combining the resetting period and the threshold voltage detection period shown in FIG. 4A. In contrast, in the case where the threshold voltage correction period is set at a different timing for each of the pixel rows, and it is assumed that there are M rows of pixel rows (M>>N), the threshold voltage correction period allocated to each pixel is at most Tf/M. Furthermore, even in the case where two signal lines are disposed for each pixel column as disclosed in PTL 1, the initialization period allocated to each pixel is at most 2Tf/M.

Furthermore, with the above-described grouping into drive blocks, the first control line for controlling the conduction between the drain of the drive transistor 114 and the organic EL element 113, and the second control line for controlling the conduction between the drain and gate of the drive transistor 114 can be provided in common in each of the drive blocks. Therefore, the number of control lines outputted from the scanning/control line drive circuit 14 is reduced. Therefore, the load on the drive circuit is reduced.

For example, in the conventional image display device 500 disclosed in PTL 1, two control lines (power supply line and scanning line) are disposed per pixel row. Assuming that the image display device 500 includes M rows of pixel rows, the control lines would total 2M lines.

In contrast, in the display device 1 according to Embodiment 1 in the present disclosure, one scanning line per pixel row and two control lines per drive block are outputted from the scanning/control line drive circuit 14. Therefore, assuming that the display device 1 includes M rows of pixel rows, the control lines (including scanning lines) would total (M+2N) lines.

Since M>>N is realized in the case of a large surface area and a large number of rows of pixels, in such case, the number of control lines in the display device 1 according to the present disclosure can be reduced to approximately half compared to the number of control lines in the conventional image display device 500.

Embodiment 2

Hereinafter, Embodiment 2 in the present disclosure shall be described with reference to the Drawings.

Figure 8:
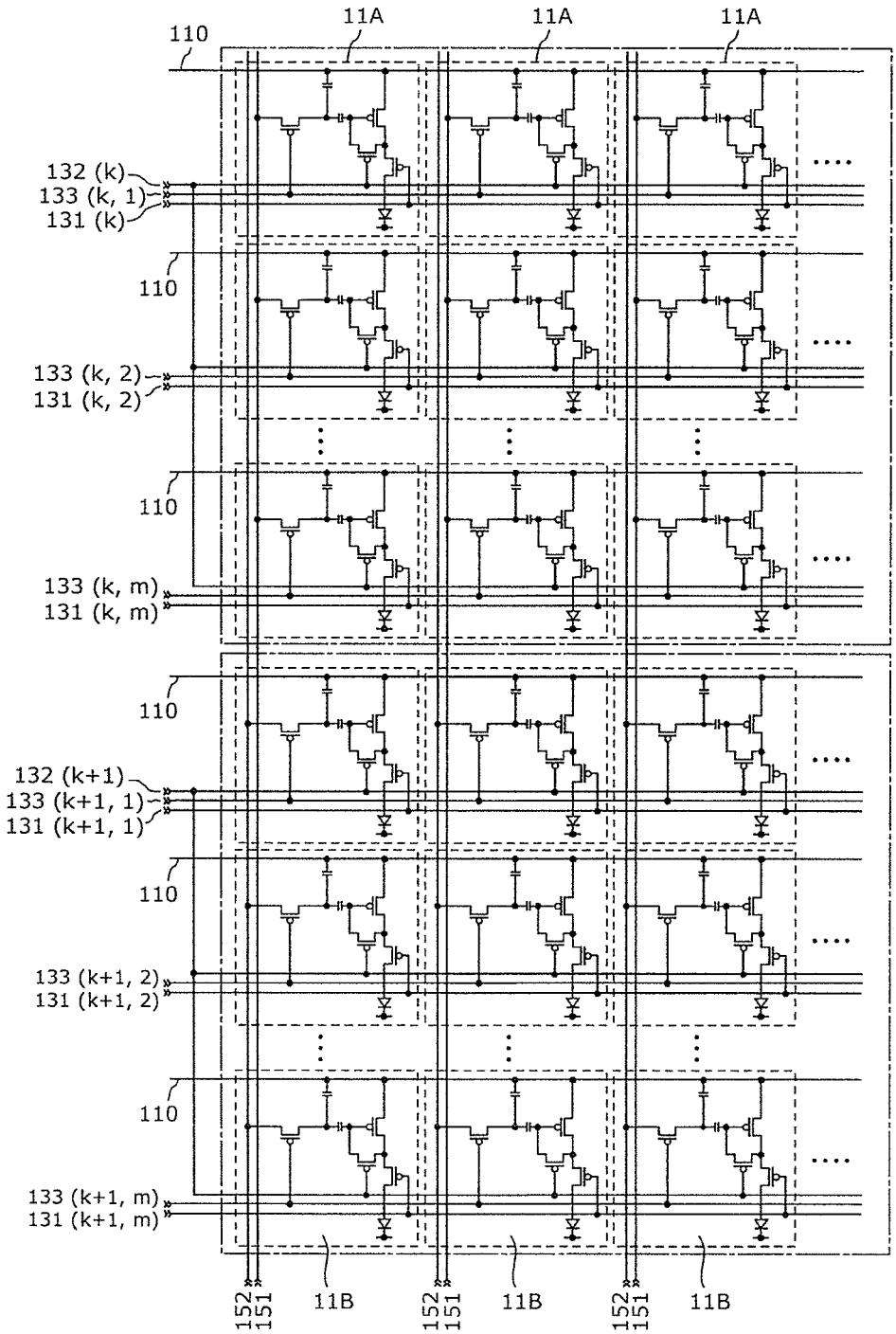
FIG. 8 is a circuit configuration diagram showing part of a display panel included in a display device according to Embodiment 2 in the present disclosure.

FIG. 8 is a circuit configuration diagram showing part of a display panel included in a display device according to the Embodiment 2 in the present disclosure. The figure shows two adjacent drive blocks and respective control lines, respective scanning lines, and respective signal lines. In the figure and the subsequent description, the respective control lines, respective scanning lines, and respective signal lines shall be represented by "reference number (block number; row number of the block)" or "reference number (block number)".

Compared to the display device 1 shown in FIG. 3, the display device shown in the figure has the same circuit configuration for the respective pixels but is different only in that the first control line 131 is not provided in common on a drive block basis and is connected on a per pixel row basis to the scanning/control line drive circuit 14 not shown in the figure. Description of points that are the same as in the display device according to the Embodiment 1 shown in FIG. 3 shall be omitted, and only the points of difference shall be described hereafter.

In the kth drive block shown at the top stage of FIG. 8, each of the first control lines 131 (*k*, 1) to 131 (*k*, m) are disposed to a corresponding one of the pixel rows in the drive block and is separately connected to the gates of the respective switching transistors 116 included in the respective pixels 11A in the drive block. Furthermore, the second control line 132 (*k*) is connected in common to the gates of the respective switching transistors 117 in the drive block. On the other hand, each of the scanning lines 133 (*k*, 1) to 133 (*k*, m) are separately connected on a per pixel row basis. Furthermore, the same connections as those in the kth drive block are also carried out on the (k+1)th drive block shown in the bottom stage of FIG. 8. Furthermore, the second control line 132 (*k*) connected to the kth drive block and the second control line 132 (*k*+1) connected to the (k+1)th drive block are different control lines, and separate control signals are outputted from the scanning/control line drive circuit 14.

Furthermore, in the kth drive block, the first signal line 151 is connected to the other of the terminals of the respective electrostatic storing capacitors C1 included in all of the pixels 11A in the drive block. Meanwhile, in the (k+1)th drive block, the second signal line 152 is connected to the other of the terminals of the respective electrostatic storing capacitors C1 included in all of the pixels 11B in the drive block.

With the above-described grouping into drive blocks, the number of second control lines 132 for controlling the pixels 11A and 11B is reduced. Therefore, the load on the scanning/control line drive circuit 14 which outputs drive signals to these control lines is reduced.

Figure 9A:
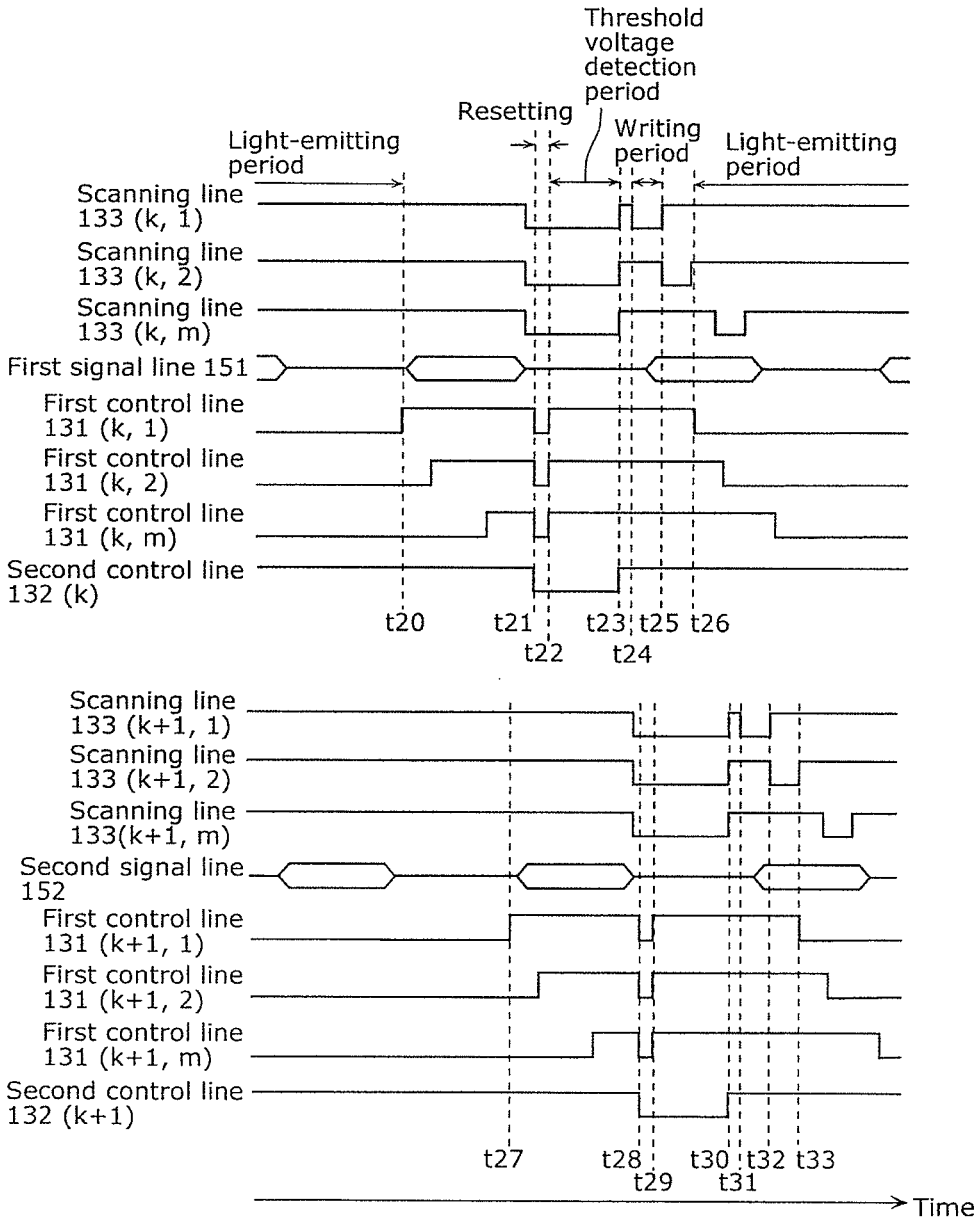
FIG. 9A is an operation timing chart for a driving method of the display device in Embodiment 2 in the present disclosure.

Next, the driving method of the display device according to this embodiment shall be described using FIG. 9A.

FIG. 9A is an operation timing chart for the driving method of the display device in Embodiment 2 in the present disclosure. In the figure, the horizontal axis denotes time. Furthermore, in the vertical direction, the waveform diagrams of the voltage generated in the scanning lines 133 (*k*, 1), 133 (*k*, 2), and 133 (*k*, m), the first signal line 151, the first control lines 131 (*k*, 1), 131 (*k*, 2), and 131 (*k*, m), and the second control line 132 (*k*) of the kth drive block are shown in sequence from the top. Furthermore, continuing therefrom, the waveform diagrams of the voltage generated in the scanning lines 133 (*k*+1, 1), 133 (*k*+1, 2), and 133 (*k*+1, m), the second signal line 152, the first control lines 131 (*k*+1, 1), 131 (*k*+1, 2), and 131 (*k*+1, m) and the second control line 132 (*k*+1) of the (k+1)th drive block are shown.

Compared to the driving method according to Embodiment 1 shown in FIG. 4A, the driving method according to this embodiment is different only in that the signal voltage writing periods as well as the light-emitting periods are set on a per pixel row basis, without the light-emitting periods being made uniform within a drive block.

First, immediately before a time t20, the voltage levels of the scanning lines 133 (*k*, 1) to 133 (*k, m*) are all HIGH, the voltage levels of the first control lines 131 (*k*, 1) to 131 (*k, m*) are all LOW, and the voltage level of the second control line 132 (*k*) is also HIGH. Specifically, a voltage corresponding to the total of the threshold voltage of the drive transistor 114 and the luminance signal voltage in the immediately preceding frame period is stored in the electrostatic storing capacitors C1 and C2, and the organic EL element 113 emits light at a luminance that is in accordance with the voltage stored in the electrostatic storing capacitors C1 and C2, as shown in (a) in FIG. 5.

Next, at the time t20, the scanning/control line drive circuit 14 causes the voltage level of the first control line 131 (*k*, 1) to change from LOW to HIGH to turn OFF the switching transistor 116. With this, the drive current from the drive transistor 114 to the organic EL element 113 of the pixels 11A belonging to the first row of the kth drive block is cut off, and thus the organic EL element 113 stops emitting light. Subsequently, the scanning/control line drive circuit 14 sequentially causes the voltage levels of the scanning lines 133 (*k*, 1) to 133 (*k, m*) to change from HIGH to LOW, thereby causing the pixels belonging to the kth drive block to stop emitting light, row-by-row sequentially. In other words, the non-light-emitting period of the kth drive block begins.

Next, by a time t21 at which the voltage level of the second control line 132 (*k*) is changed to the LOW level, the scanning/control line drive circuit 14 causes the voltage levels of the scanning lines 133 (*k*, 1) to 133 (*k, m*) to simultaneously change from HIGH to LOW to turn ON the respective switching transistors 115. Furthermore, at this time, the voltage levels of the first control lines 131 (*k*, 1) to 131 (*k, m*) are already at LOW and the switching transistor 116 is already ON, and the signal line drive circuit 15 causes the signal voltage of the first signal line 151 to change from the luminance signal voltage to the reference voltage. With this, the reference voltage is applied to the voltage-dividing point M (step S11 in FIG. 6). It should be noted that the timing for simultaneously changing the voltage level of the first control lines 131 (*k*, 1) to 131 (*k, m*) from HIGH to LOW may be the same as the timing for changing the voltage level of the second control line 132 (*k*) to the LOW level. In other words, the timing may be at the time t21.

Next, at the time t21, the scanning/control line drive circuit 14 causes the voltage level of the second control line 132 (*k*) to change from HIGH to LOW to turn ON the respective switching transistors 117 (step S12 in FIG. 6). Furthermore, at this time, since the voltage levels of the first control lines 131 (*k*, 1) to 131 (*k, m*) are maintained at LOW, the gate voltage of the drive transistor 114 is reset to the initializing voltage (VR2) with which the gate-source voltage of the drive transistor 114 becomes greater than or equal to the threshold voltage. Stated differently, the gate-source voltage of the drive transistor 114 is set to the potential difference which allows for detection of the threshold voltage Vth of the drive transistor 114, and the preparation for the threshold voltage detection process is completed.

Next, at a time t22, the scanning/control line drive circuit 14 causes the voltage levels of the first control lines 131 (*k*, 1) to 131 (*k, m*) to concurrently change from LOW to HIGH to turn OFF the respective switching transistors 116 (step S13 in FIG. 6). At this time, as shown in (c) in FIG. 5, the drive transistor 114 is continuously ON, and thus the drain current of the drive transistor 114 flow from the drain of the drive transistor 114 to the gate of the drive transistor 114. As a result, the voltage level of the gate of the drive transistor 114 becomes asymptotic to VDD−Vth which is a voltage that is lower than the voltage level (VDD) of the source of the drive transistor 114 by the threshold voltage (Vth), defined by Expression 1. With this, a voltage corresponding to the threshold voltage of the drive transistor 114 is stored in the electrostatic storing capacitor C1. Specifically, a voltage VC1 stored in the electrostatic storing capacitor C1 is a voltage defined by Expression 2.

In the period from the time t22 to a time t23, the circuit of the pixel 11A becomes steady, and the voltage corresponding to the threshold voltage Vth of the drive transistor 114 is stored in the electrostatic storing capacitor C1. It should be noted that, since the flowing current for causing the voltage corresponding to the threshold voltage Vth to be stored in the electrostatic storing capacitor C1 is minute, reaching the steady state takes time. Therefore, the longer this period is, the more stable the voltage stored in the electrostatic storing capacitor C1 becomes, and by ensuring that this period is sufficiently long, precise voltage compensation is realized.

Next, at the time t23, the scanning/control line drive circuit 14 causes the voltage level of the second control line 132 (*k*) to change from LOW to HIGH to simultaneously turn OFF the respective switching transistors 117 included in all the pixels 11A in the kth drive block (step S14 in FIG. 6). This completes the threshold voltage detection operation of the pixels 11A belonging to the kth drive block.

As described thus far, in the period from the time t22 to the time t23, the correction of the threshold voltage Vth of the drive transistor 114 is executed simultaneously in the kth drive block, and a voltage corresponding to the threshold voltage Vth of the drive transistor 114 is stored simultaneously in the respective electrostatic storing capacitors C1 of all the pixels 11A in the kth drive block.

Furthermore, at the time t23, the scanning/control line drive circuit 14 causes the voltage levels of the scanning lines 133 (*k*, 1) to 133 (*k, m*) to simultaneously change from LOW to HIGH to turn ON the respective switching transistors 115. With this, the supply of the reference voltage VR1 to the voltage-dividing point M is stopped. It should be noted that the timing for causing the voltage levels of the scanning lines 133 (*k*, 1) to 133 (*k, m*) to change from LOW to HIGH is not limited to such, and may be anywhere in the period from the time t23 up to when a luminance signal voltage is supplied from the first signal line 151.

Next, from the time t24 onward, the scanning/control line drive circuit 14 causes the voltage levels of the scanning lines 133 (*k*, 1) to 133 (*k, m*) to sequentially change from HIGH to LOW to HIGH so as to sequentially turn ON the switching transistors 115 on a per pixel row basis. Furthermore, at this time, the signal line drive circuit 15 causes the signal voltage of the first signal line 151 to change from the reference voltage VR1 to the luminance signal voltage Vdata. Specifically, as shown in (e) in FIG. 5, the luminance signal voltage Vdata is applied to the voltage-dividing point (step S15 in FIG. 6). With this, the gate voltage of the drive transistor 114 becomes Vg as defined in Expression 3. Specifically, for the gate-source voltage Vgs of the drive transistor 114, a luminance signal voltage corrected by the threshold voltage as defined in Expression 4 is written.

Furthermore, after causing the voltage level of the scanning line 133 (*k*, 1) to change from HIGH to LOW to HIGH, the scanning/control line drive circuit 14 next causes the voltage level of the first control line 131 (*k*, 1) to change from HIGH to LOW. In other words, the respective switching transistors 116 in all of the pixels 11A in the kth drive block are sequentially turned ON on a per pixel row basis (step S16 in FIG. 6).

This operation is sequentially repeated on a per pixel row basis.

As described thus far, from the time t24 onward, the writing of the corrected luminance signal voltage and the emission of light are sequentially executed in the kth drive block on a per pixel row basis.

As described above, grouping the pixel rows into drive blocks allows the correction of the threshold voltage Vth of the drive transistors 114 to be executed simultaneously in the respective drive blocks. With this, the control of the current path of such drive current from the drain onward can be synchronized in the respective drive blocks. Therefore, the second control line 132 can be provided in common in each of the drive blocks.

Furthermore, although the scanning lines 133 (*k*, 1) to 133 (*k, m*) are separately connected to the scanning/control line drive circuit 14, the timing of the HIGH level period and the LOW level period of the drive pulse (control signal) outputted from the scanning/control line drive circuit 14 in the threshold voltage correction period is the same. Therefore, the scanning/control line drive circuit 14 can suppress the rising of the frequency of the drive pulse to be outputted, and thus the output load on the drive circuit can be reduced.

From the same perspective as Embodiment 1, this embodiment also has the advantage that light emission duty can be secured longer compared to the conventional image display device using two signal lines disclosed in PTL 1.

Therefore, it is possible to realize a display device that ensures sufficient light-emitting luminance and has long operational life due to reduced output load on drive circuits.

Furthermore, it is understood that when the same light emission duty is set to the conventional image display device using two signal lines and the display device combining block driving as in the present disclosure, the display device according to the present disclosure ensures a longer threshold voltage detection time.

The driving method of the display device according to this embodiment shall be described once again.

Meanwhile, at a time t27, the correction of the threshold voltage of the drive transistors 114 in the (k+1)th drive block begins.

First, immediately before the time t27, the voltage levels of the scanning lines 133 (*k*+1, 1) to 133 (*k*+1, m) are all HIGH, the voltage levels of the first control lines 131 (*k*+1, 1) to 131 (*k*+1, m) are all LOW, and the voltage level of the second control line 132 (*k*+1) is HIGH. Specifically, as in (a) in FIG. 5, the organic EL element 113 emits light at a luminance corresponding to the voltage stored in the electrostatic storing capacitors C1 and C2.

Next, at the time t27, the scanning/control line drive circuit 14 causes the voltage level of the first control line 131 (*k*+1, 1) to change from LOW to HIGH to turn OFF the switching transistors 116. With this, the drive current from the drive transistor 114 of the pixels 11B belonging to the first row of the (k+1)th drive block is cut off, and the respective organic EL elements 113 stop emitting light. Subsequently, the scanning/control line drive circuit 14 sequentially causes the voltage levels of the scanning lines 133 (*k*+1, 2) to 133 (*k*+1, m) to change from HIGH to LOW, thereby causing the pixels belonging to the (k+1)th drive block to stop emitting light, row-by-row sequentially. In other words, the non-light-emitting period of the (k+1)th drive block begins.

Next, by a time t28 at which the voltage level of the second control line 132 (*k*+1) is changed to the LOW level, the scanning/control line drive circuit 14 causes the voltage levels of the scanning lines 133 (*k*+1, 1) to 133 (*k*+1, m) to simultaneously change from HIGH to LOW to turn ON the respective switching transistors 115. Furthermore, at this time, the voltage levels of the first control lines 131 (*k*+1, 1) to 131 (*k*+1, m) are already at LOW and the switching transistor 116 is already ON, and the signal line drive circuit 15 causes the signal voltage of the second signal line 152 to change from the luminance signal voltage to the reference voltage. With this, the reference voltage is applied to the voltage-dividing point M (step S21 in FIG. 6). It should be noted that the timing for simultaneously changing the voltage level of the first control lines 131 (*k*+1, 1) to 131 (*k*+1, m) from HIGH to LOW may be the same as the timing for changing the voltage level of the second control line 132 (*k*+1) to the LOW level. In other words, the timing may be at the time t28.

Next, at the time t28, the scanning/control line drive circuit 14 causes the voltage level of the second control line 132 (*k*+1) to change from HIGH to LOW to turn ON the respective switching transistors 117 (step S22 in FIG. 6). Furthermore, at this time, since the voltage levels of the first control lines 131 (*k*+1, 1) to 131 (*k*+1, m) are maintained at LOW, the gate voltage of the drive transistor 114 is reset to the initializing voltage (VR2) with which the gate-source voltage of the drive transistor 114 becomes greater than or equal to the threshold voltage. Stated differently, the gate-source voltage of the drive transistor 114 is set to the potential difference which allows for detection of the threshold voltage Vth of the drive transistor 114, and the preparation for the threshold voltage detection process is completed.

Next, at a time t29, the scanning/control line drive circuit 14 causes the voltage levels of the first control lines 131 (*k*+1, 1) to 131 (*k*+1, m) to concurrently change from LOW to HIGH to turn OFF the respective switching transistors 116 (step S23 in FIG. 6). With this, the drive transistor 114 is turned ON, and as a result, the voltage level of the gate of the drive transistor 114 becomes asymptotic to VDD−Vth which is a voltage that is lower than the voltage level (VDD) of the source of the drive transistor 114 by the threshold voltage (Vth). With this, a voltage corresponding to the threshold voltage of the drive transistor 114 is stored in the electrostatic storing capacitor C1.

In the period from the time t29 to a time t30, the circuit of the pixel 11B becomes steady, and the voltage corresponding to the threshold voltage Vth of the drive transistor 114 is stored in the electrostatic storing capacitor C1. It should be noted that, since the flowing current for causing the voltage corresponding to the threshold voltage Vth to be stored in the electrostatic storing capacitor C1 is minute, reaching the steady state takes time. Therefore, the longer this period is, the more stable the voltage stored in the electrostatic storing capacitor C1 becomes, and by ensuring that this period is sufficiently long, precise voltage compensation is realized.

Next, at the time t30, the scanning/control line drive circuit 14 causes the voltage level of the second control line 132 (*k*+1) to change from LOW to HIGH to simultaneously turn OFF the respective switching transistors 117 included in all the pixels 11B belonging to the (k+1)th drive block (step S24 in FIG. 6). This completes the threshold voltage detection operation of the pixels 11B belonging to the (k+1)th drive block.

Thus, in the period from the time t29 to the time t30, the correction of the threshold voltage Vth of the drive transistor 114 is executed simultaneously in the (k+1)th drive block, and a voltage corresponding to the threshold voltage Vth of the drive transistor 114 is stored simultaneously in the respective electrostatic storing capacitors C1 of all the pixels 11B in the (k+1)th drive block.

Furthermore, at the time t30, the scanning/control line drive circuit 14 causes the voltage levels of the scanning lines 133 (*k*+1, 1) to 133 (*k*+1, m) to simultaneously change from LOW to HIGH to turn OFF the respective switching transistors 115. With this, the supply of the reference voltage VR1 to the voltage-dividing point M is stopped. It should be noted that the timing for causing the voltage levels of the scanning lines 133 (*k*+1, 1) to 133 (*k*+1, m) to change from LOW to HIGH is not limited to such, and may be anywhere in the period from the time t30 up to when a luminance signal voltage is supplied from the second signal line 152.

Next, in from a time t31 onward, the scanning/control line drive circuit 14 causes the voltage levels of the scanning lines 133 (*k*+1, 1) to 133 (*k*+1, m) to sequentially change from HIGH to LOW to HIGH to sequentially turn ON the switching transistors 115 on a per pixel row basis. Furthermore, at this time, the signal line drive circuit 15 causes the signal voltage of the second signal line 152 to change from the reference voltage to the luminance signal voltage. Specifically, the luminance signal voltage Vdata is applied to the voltage-dividing point M (step S25 in FIG. 6). With this, a voltage corresponding to the luminance signal voltage Vdata and the threshold voltage Vth is written into the gate of the drive transistor 114. Specifically, for the gate-source voltage Vgs of the drive transistor 114, a luminance signal voltage corrected by the threshold voltage is written.

Furthermore, after causing the voltage level of the scanning line 133 (*k*+1, 1) to change from HIGH to LOW to HIGH, the scanning/control line drive circuit 14 next causes the voltage level of the first control line 131 (*k*+1, 1) to change from HIGH to LOW. In other words, the respective switching transistors 116 in all of the pixels 11B in the (k+1)th drive block are sequentially turned ON (step S26 in FIG. 6).

This operation is sequentially repeated on a per pixel row basis.

As described thus far, from the time t31 onward, the writing of the corrected luminance signal voltage and the light emission are sequentially executed in the (k+1)th drive block on a per pixel row basis.

The operations described thus far are also executed sequentially in the (k+2)th drive block onward in the display panel 10.

Figure 9B:
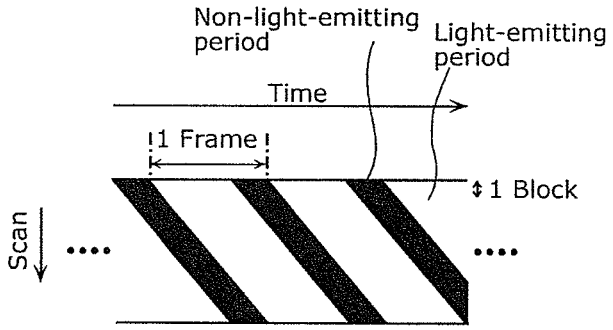
FIG. 9B is a state transition diagram of a drive block which emits light according to the driving method according to Embodiment 2 in the present disclosure.

FIG. 9B is a state transition diagram of a drive block which emits light according to the driving method according to Embodiment 2 in the present disclosure. In the figure, the light-emitting periods and the non-light-emitting periods of each drive block in a certain pixel column are shown. Plural drive blocks are shown in the vertical direction, and the horizontal axis shows time. Here, the non-light-emitting production period includes the above-described threshold voltage correction period.

According to the driving method of the display device according to Embodiment 2 in the present disclosure, the light-emitting periods are also sequentially set on a per pixel row basis within the same drive block. Therefore, even within a drive block, the light-emitting periods appear in a continuous manner with respect to the row scanning direction.

Thus, the drive transistor 114 threshold voltage correction periods as well as the timings thereof can also be made uniform within the same drive block in Embodiment 2 through the pixel circuit provided with the switching transistors 116 and 117 and the electrostatic storing capacitors C1 and C2, and through the arrangement of control lines, scanning lines, and signal lines to the respective pixels that have been grouped into drive blocks. Therefore, the load on the scanning/control line drive circuit 14 which outputs signals for controlling current paths, and on the signal line drive circuit 15 which controls signal voltages is reduced. In addition, through the above-described grouping into drive blocks and the two signal lines arranged for every pixel column, the threshold voltage correction period of the drive transistor 114 can occupy a large part of a 1-frame period Tf which is the time in which all the pixels are refreshed. This is because the threshold voltage correction period is provided in the (k+1)th drive block in the period in which the luminance signal is sampled in the kth drive block. Therefore, the threshold voltage correction period is not divided on a per pixel row basis, but is divided on a per drive block basis. Therefore, as the display area is increased, a long relative threshold voltage correction period can be set with respect to 1-frame period, without allowing light emission duty to decrease with the increase in the display area. With this, a drive current based on luminance signal voltage that has been corrected with a high degree of precision flows to the light-emitting elements, and thus image display quality improves.

For example, in the case where the display panel 10 is divided into N drive blocks, the threshold voltage correction period allocated to each pixel is at most Tf/N.

Embodiment 3

The display device according to Embodiment 3 in the present disclosure is almost the same as the display device 1 according to Embodiment 1 but is different in the configuration of the pixels.

Specifically, a point of difference is that, in Embodiment 1, one terminal of the electrostatic storing capacitor C2 is connected to the terminal of the electrostatic storing capacitor C1 that is not connected to the drive transistor 114, whereas, in Embodiment 3, one terminal of the electrostatic storing capacitor C2 is connected to the terminal of the electrostatic storing capacitor C1 that is connected to the drive transistor 114.

Hereinafter, Embodiment 3 in the present disclosure shall be described with reference to the Drawings.

Figure 10A:
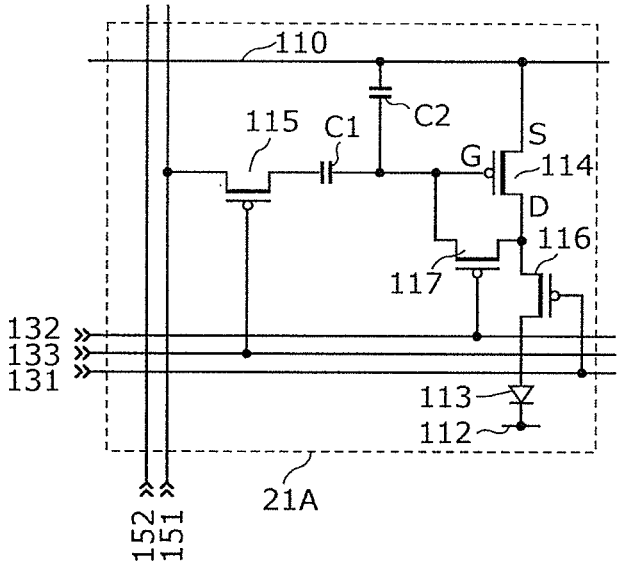
FIG. 10A is a specific circuit configuration diagram of a pixel of an odd drive block in a display device according to Embodiment 3 in the present disclosure.
Figure 10B:
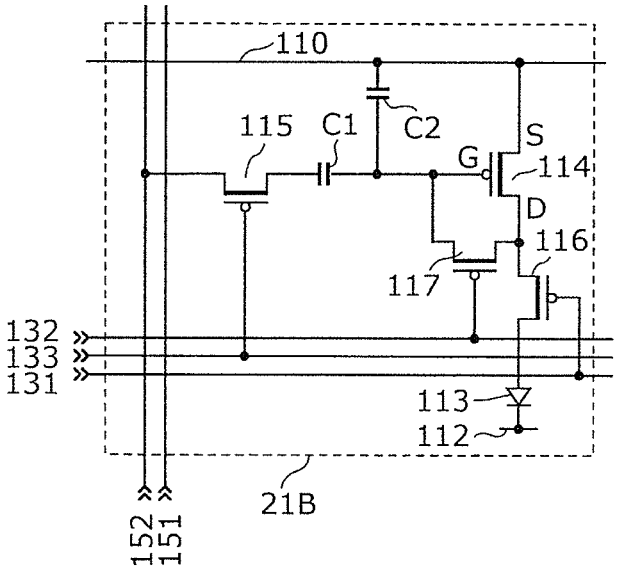
FIG. 10B is a specific circuit configuration diagram of a pixel of an even drive block in the display device according to Embodiment 3 in the present disclosure.

FIG. 10A is a specific circuit configuration diagram of a pixel of an odd drive block in a display device according to Embodiment 3 in the present disclosure, and FIG. 10B is a specific circuit configuration diagram of a pixel of an even drive block in a display device according to Embodiment 3 in the present disclosure.

A pixel 21A shown in FIG. 10A is almost the same as the pixel 11A shown in FIG. 2A but the position at which the electrostatic storing capacitor C1 is provided is different. Meanwhile, a pixel 21B shown in FIG. 10B is almost the same as the pixel 11B shown in FIG. 2B but the position at which the electrostatic storing capacitor C1 is provided is different. Specifically, in both the pixel 21A and pixel 21B, one terminal of the electrostatic storing capacitor C2 is connected to the terminal of the electrostatic storing capacitor C1 that is connected to the drive transistor 114.

It should be noted that the operation timing chart for the driving method of the display device according to this embodiment is the same as the operation timing chart for the driving method of the display device according to Embodiment 1 shown in FIG. 4A. Furthermore, the operation flowchart of the display device according to this embodiment is almost the same as the operation flowchart of the display device according to Embodiment 1 shown in FIG. 5, but the point to which the reference voltage and the luminance signal voltage described in steps S11, S15, S21, and S25 in FIG. 5 is applied is different.

Specifically, in Embodiment 1, the reference voltage and the luminance signal voltage supplied from the first signal line 151 and the second signal line 152 are applied to the voltage-dividing point M of the electrostatic storing capacitor C1 and the electrostatic capacitor C2, whereas, in Embodiment 3, the signal voltage is supplied to a terminal of the electrostatic storing capacitor C1 that is not connected to the electrostatic storing capacitor C2.

Furthermore, another point of difference is that, in Embodiment 1, a voltage corresponding to the threshold voltage Vth of the drive transistor 114 is stored in the electrostatic storing capacitor C1, whereas in this embodiment, such voltage is stored in the voltage-dividing point M of the electrostatic storing capacitor C1 and the electrostatic capacitor C2.

Accordingly, since the voltage applied to the gate of the drive transistor 114 is dependent on and determined according to the capacitance division between the electrostatic storing capacitor C1 and the electrostatic capacitor C2 in Embodiment 3, it is necessary to make the amplitude of the luminance signal voltage big compared to Embodiment 1. Specifically, compared to Embodiment 1, the ratio of the maximum amplitude of the luminance signal voltage to the maximum amplitude of the gate-source voltage of the drive transistor 114 decreases.

However, since the drive transistor 114 threshold voltage correction periods as well as the timings thereof can be made uniform within the same drive block in the same manner as in the display device 1 according to Embodiment 1, the display device according to this embodiment can also produce the same advantageous effects as the display device 1 according to Embodiment 1 such as, for example, reducing the load on the signal line drive circuit 15 and improving display quality through precise threshold voltage correction.

Although Embodiments 1 to 3 have been described thus far, the display device according to the present disclosure is not limited to the above-described embodiments. The present disclosure includes other embodiments implemented through a combination of arbitrary components of Embodiments 1 to 3, or modifications obtained through the application of various modifications to Embodiments 1 to 3 and the modifications thereto, that may be conceived by a person of ordinary skill in the art, that do not depart from the essence of the embodiments or features disclosed herein, or various devices in which the display device according to one or more exemplary embodiments is built into.

For example, although in the foregoing description, the constituent elements other than the pixels 21A and 21B in the display device according to Embodiment 3 have the same configuration as in the display device 1 according to Embodiment 1, the constituent elements other than the pixels 21A and 21B may have the same configuration as in the display device according to Embodiment 2 shown in FIG. 8, and operate according to the operation timing chart of the display device according to Embodiment 2 shown in FIG. 9A, thereby cause light emission and stop light emission row-by-row sequentially.

It should be noted that although, in the aforementioned embodiments, description is carried out under the assumption that the switching transistors are P-type transistors which turn ON when the voltage level of the gate of switching transistor is LOW, the same advantageous effects are produced as in the respective embodiments even with a display device in which the switching transistors are configured of N-type transistors and the polarity of the scanning lines and control lines are reversed.

Furthermore, although in the above-described embodiments the cathode-side of the respective organic EL elements is connected in common with another pixel, the same advantageous effects are produced as in the above-described embodiments even with a display device in which the cathode-side is connected to the drive transistor 114 via the switching transistor 116.

Furthermore, although the voltage levels of the first control lines 131 ($k$, 1) to 131 ($k$, $m$) in the kth drive block are caused to simultaneously change from HIGH to LOW by the time t21, the voltage levels may be caused to change row-by-row sequentially instead of simultaneously. Furthermore, although the voltage levels of the first control lines 131 ($k$+1, 1) to 131 ($k$+1, m) are caused to simultaneously change from HIGH to LOW by the time t28, the voltage levels may be caused to change row-by-row sequentially instead of simultaneously.

Figure 11:
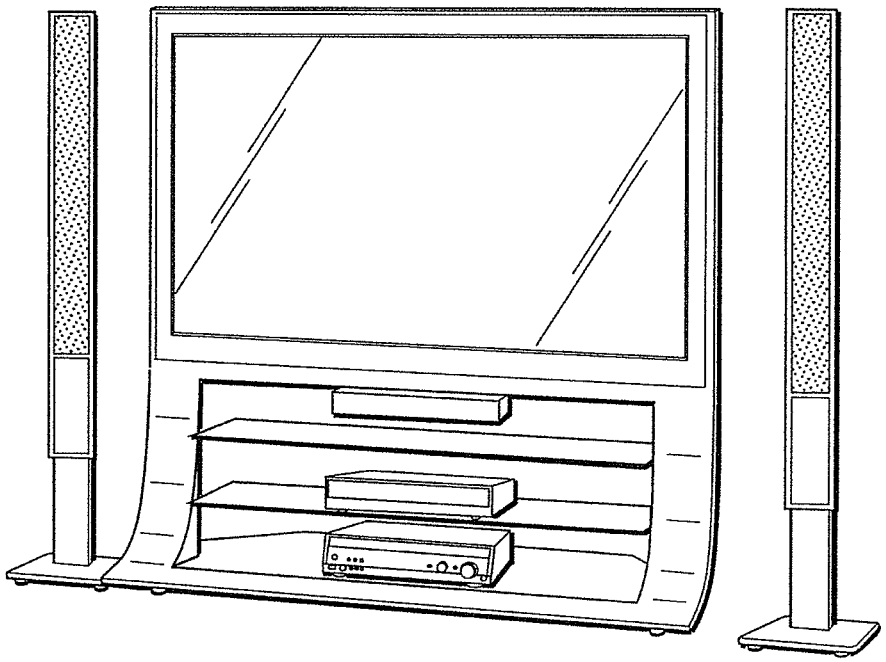
FIG. 11 is an external view of a thin flat-screen TV incorporating a display device according to the present disclosure.
Figure 12:
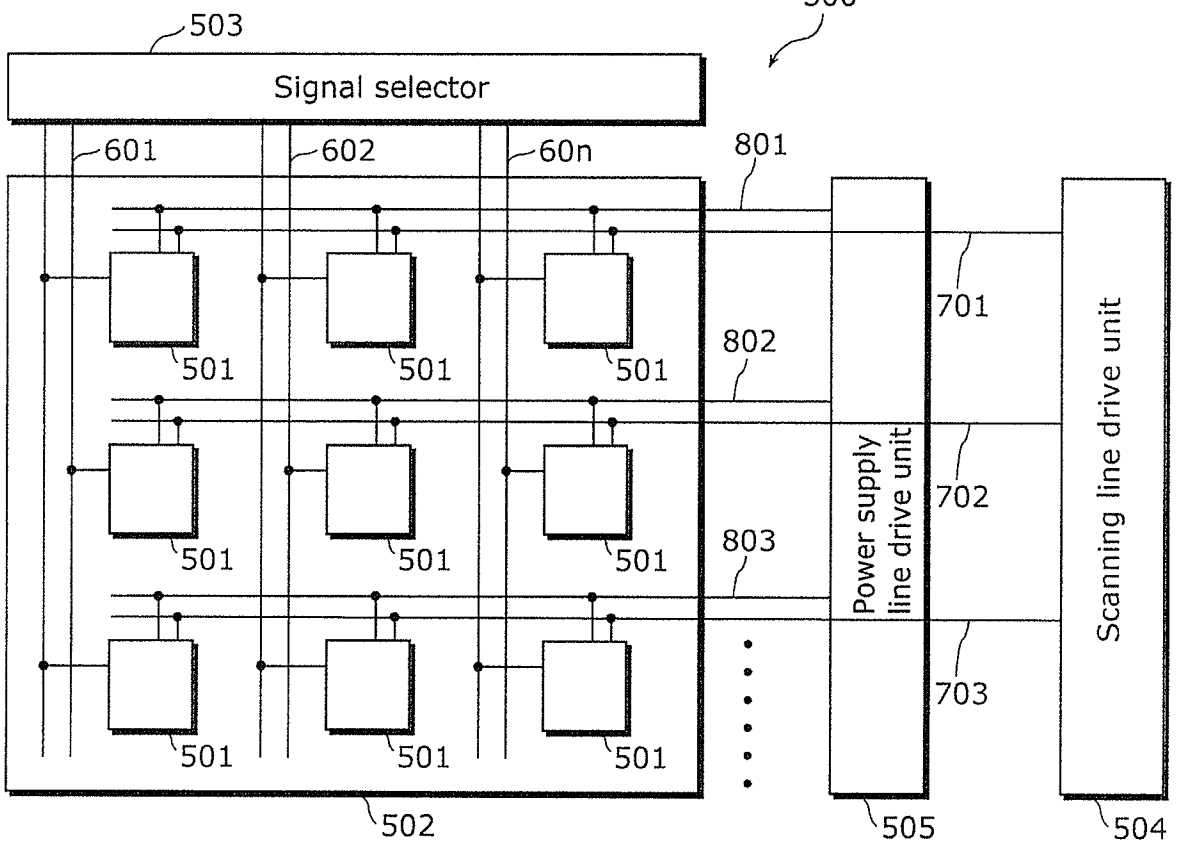
FIG. 12 is a block diagram showing the configuration of a conventional image display device disclosed in PTL 1.
Figure 13:
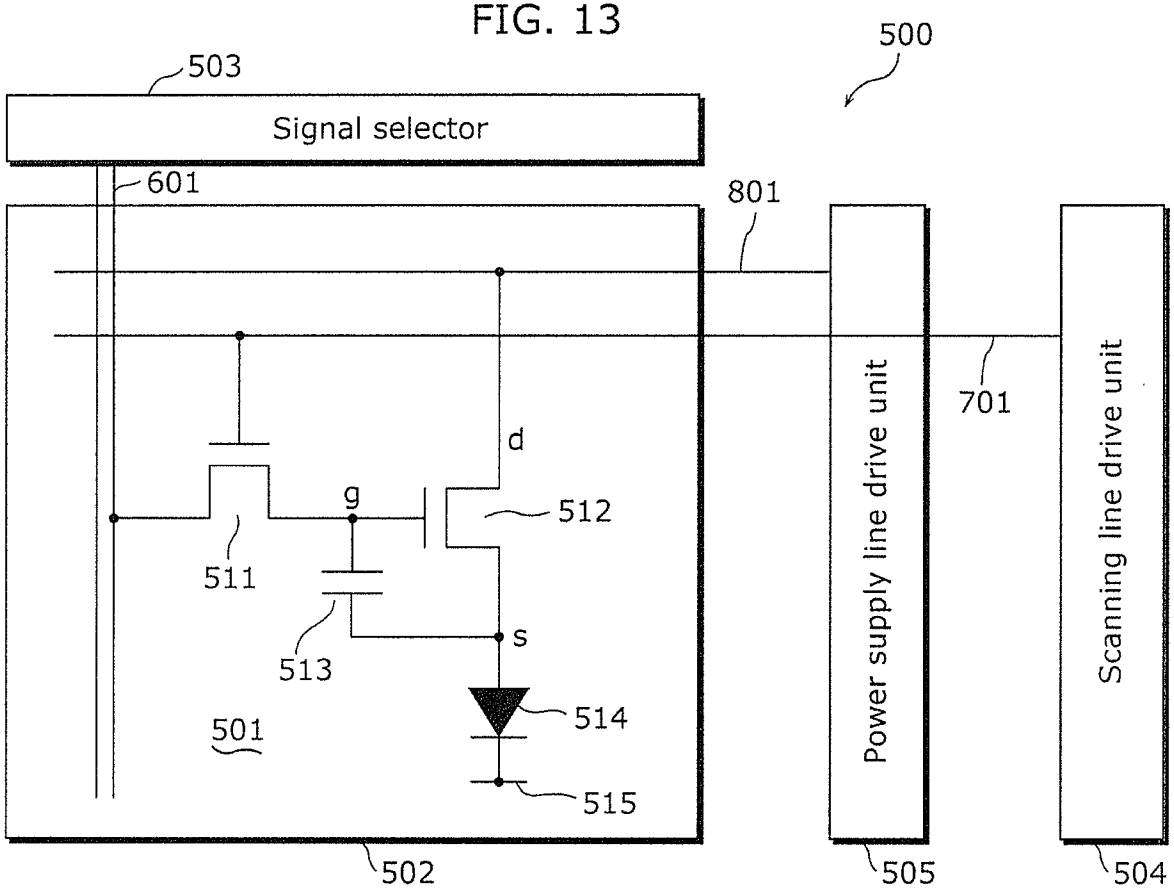
FIG. 13 is a circuit configuration diagram for a pixel included in the conventional image display device disclosed in PTL 1.
Figure 14:
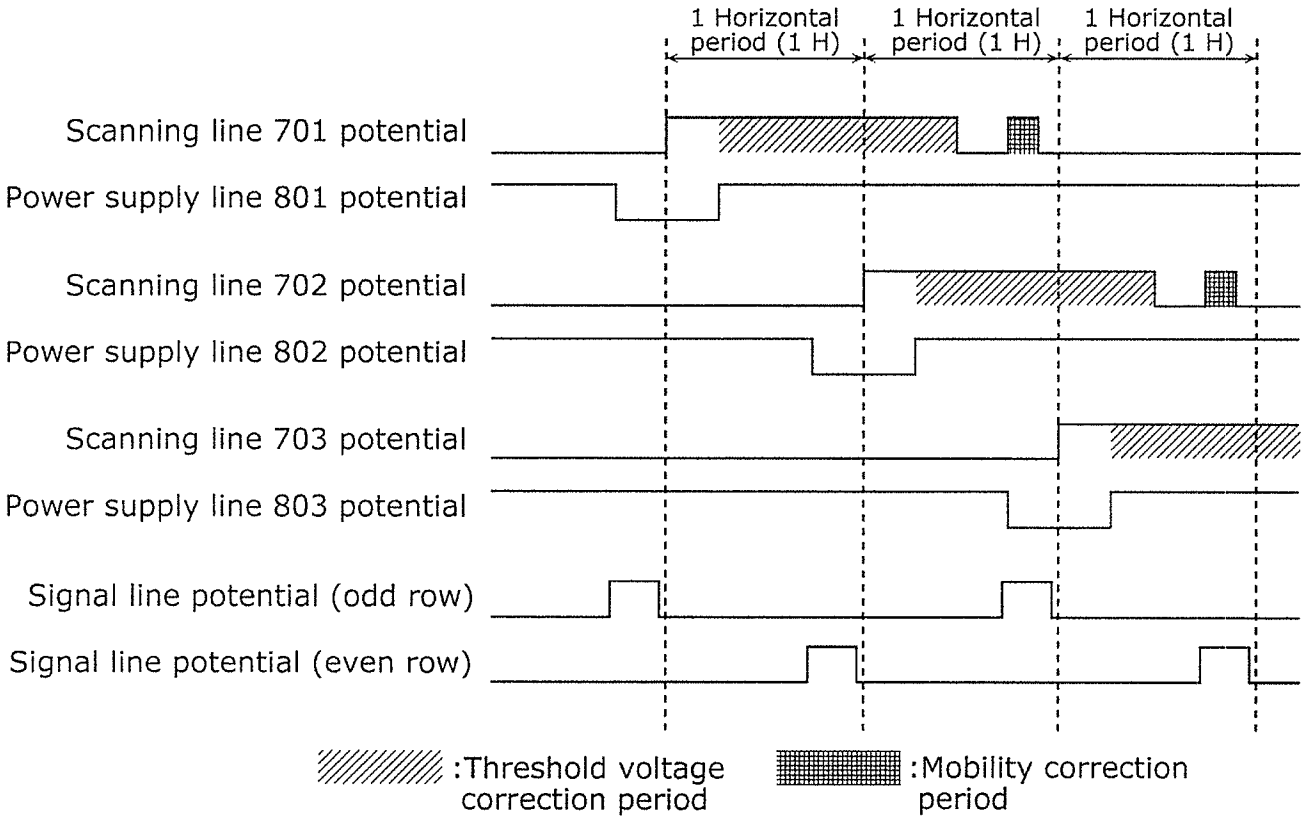
FIG. 14 is an operation timing chart for the image display device disclosed in PTL 1.

Furthermore, for example, the display device in the present disclosure is built into a thin, flat TV shown in FIG. 11. A thin flat-screen TV capable of precise image display reflecting a video signal is implemented by having the display device according to the present disclosure built into the TV.

Each of the structural elements in each of the above-described embodiments may be configured in the form of an exclusive hardware product, or may be realized by executing a software program suitable for the structural element. Each of the structural elements may be realized by means of a program executing unit, such as a CPU and a processor, reading and executing the software program recorded on a recording medium such as a hard disk or a semiconductor memory.

The herein disclosed subject matter is to be considered descriptive and illustrative only, and the appended Claims are of a scope intended to cover and encompass not only the particular embodiment(s) disclosed, but also equivalent structures, methods, and/or uses.

INDUSTRIAL APPLICABILITY

The display device and the driving method according to one or more exemplary embodiments disclosed herein are particularly useful in an active-type organic EL flat panel display which causes luminance to fluctuate by controlling pixel light emission intensity according to a pixel signal current.

The invention claimed is:

1. A display device including pixels arranged in rows and columns, the display device comprising:

a first signal line and a second signal line which are disposed in each of the columns, for supplying the pixels with a signal voltage that determines luminance of the pixels;

a first power source line and a second power source line;

a scanning line disposed in each of the rows;

a first control line and a second control line which are disposed in each of the rows, a signal line drive circuit that outputs the signal voltage to the first signal line and the second signal line; and a timing control circuit that controls a timing at which the signal line drive circuit outputs the signal voltage, wherein the pixels compose at least two driving blocks each of which includes at least two of the rows, each of the pixels includes:

a light-emitting element that includes terminals, one of the terminals being connected to the second power source line, the light-emitting element emitting light according to a flow of a signal current corresponding to the signal voltage;

a drive transistor that includes a gate, a source, and a drain and converts the signal voltage applied between the gate and the source of the drive transistor into the signal current, one of the source and the drain being connected to the first power source line;

a first capacitive element that includes terminals, one of the terminals being connected to the gate of the drive transistor;

a second capacitive element that includes terminals, one of the terminals being connected to the one or the other of the terminals of the first capacitive element, and the other of the terminals being connected to the source of the drive transistor;

a first switching transistor that includes a gate connected to the second control line, one of a source and a drain connected to the gate of the drive transistor, and the other of the source and the drain connected to the drain of the drive transistor; and a second switching transistor that includes a gate connected to the first control line, and a source and a drain which are arranged between the other of the source and the drain of the drive transistor and the other of the terminals of the light-emitting element, each of the pixels in a kth drive block of the drive blocks further includes a third switching transistor that includes a gate connected to the scanning line, one of a source and a drain connected to the first signal line, and the other of the source and the drain connected to the other of the terminals of the first capacitive element, k being a positive integer, each of the pixels in a (k+1)th drive block of the drive blocks further includes a fourth switching transistor that includes a gate connected to the scanning line, one of a source and a drain connected to the second signal line, and the other of the source and the drain connected to the other of the terminals of the first capacitive element, the second control line is connected to the pixels in a same one of the drive blocks and not connected to the pixels in different ones of the drive blocks, a threshold voltage of the drive transistor of each of the pixels in the (k+1)th drive block is corrected in a period for writing a luminance signal voltage for causing the light-emitting element of each of the pixels in the kth drive block to emit the light, the signal voltage includes the luminance signal voltage and a reference voltage for causing a voltage corresponding to the threshold voltage of the drive transistor to be stored in the first capacitive element and the second capacitive element, and the timing control circuit (i) causes the signal line drive circuit to output the reference voltage to the second signal line when the signal line drive circuit is outputting the luminance final voltage to the first signal line, and (ii) causes the signal line drive circuit to output the reference voltage to the first signal line when the signal line drive circuit is outputting the luminance signal voltage to the second signal line.

2. The display device according to claim 1, wherein the first control line is connected to the pixels in a same one of the drive blocks and not connected to the pixels in different ones of the drive blocks.

3. The display device according to claim 1, wherein, where a period of time for refreshing all of the pixels is Tf, and a total number of the drive blocks is N, a period of time for detecting the threshold voltage of the drive transistor is at most Tf/N.

4. A display device including pixels arranged in rows and columns, the display device comprising:

a first signal line and a second signal line which are disposed in each of the columns, for supplying the pixels with a signal voltage that determines luminance of the pixels;

a first power source line and a second power source line;

a scanning line disposed in each of the rows; and a first control line and a second control line which are disposed in each of the rows, a drive circuit that drives each of the pixels by controlling the first signal line, the second signal line, the first control line, the second control line, and the scanning line, wherein the pixels compose at least two driving blocks each of which includes at least two of the rows, each of the pixels includes:

a light-emitting element that includes terminals, one of the terminals being connected to the second power source line, the light-emitting element emitting light according to a flow of a signal current corresponding to the signal voltage;

a drive transistor that includes a t ate, a source, and a drain and converts the signal voltage applied between the gate and the source of the drive transistor into the signal current, one of the source and the drain being connected to the first power source line;

a first capacitive element that includes terminals, one of the terminals being connected to the gate of the drive transistor;

a second capacitive element that includes terminals, one of the terminals being connected to the one or the other of the terminals of the first capacitive element, and the other of the terminals being connected to the source of the drive transistor;

a first switching transistor that includes a gate connected to the second control line, one of a source and a drain connected to the ate of the drive transistor and the other of the source and the drain connected to the drain of the drive transistor; and a second switching transistor that includes a gate connected to the first control line, and a source and a drain which are arranged between the other of the source and the drain of the drive transistor and the other of the terminals of the light-emitting element, each of the pixels in a kth drive block of the drive blocks further includes a third switching transistor that includes a gate connected to the scanning line, one of a source and a drain connected to the first signal line, and the other of the source and the drain connected to the other of the terminals of the first capacitive element, k being a positive integer, each of the pixels in a (k+1)th drive block of the drive blocks further includes a fourth switching transistor that includes a gate connected to the scanning line, one of a source and a drain connected to the second signal line, and the other of the source and the drain connected to the other of the terminals of the first capacitive element, the second control line is connected to the pixels in a same one of the drive blocks and not connected to the pixels in different ones of the drive blocks, a threshold voltage of the drive transistor of each of the pixels in the (k+1)th drive block is element of each of the pixels in the kth drive block to emit the the drive circuit:

simultaneously applies an initializing voltage to the gate of the drive transistor of each of the pixels in the kth drive block by turning ON the third switching transistor using a scanning signal from the scanning line and turning ON the first switching transistor of each of the pixels in the kth drive block using a control signal from the second control line, in a state in which the second switching transistor is turned ON using a control signal from the first control line, the initializing voltage causing a gate-source voltage of the drive transistor to be higher than or equal to the threshold voltage of the drive transistor;

simultaneously turns OFF the second switching transistor of each of the pixels in the kth drive block, in a state in which the first switching transistor and the third switching transistor are ON;

simultaneously applies the initializing voltage to the gate of the drive transistor of each of the pixels in the (k+1)th drive block by turning ON the fourth switching transistor using a scanning signal from the scanning line and turning ON the first switching transistor of each of the pixels in the (k+1)th drive block using a control signal from the second control line, in a state in which the second switching transistor is turned ON using a control signal from the first control line; and simultaneously turns OFF the second switching transistor of each of the pixels in the (k+1)th drive block, in a state in which the first switching transistor and the fourth switching transistor are ON.

5. The display device according to claim 4, wherein the first control line is connected to the pixels in a same one of the drive blocks and not connected to the pixels in different ones of the drive blocks.

6. The display device according to claim 4, wherein, where a period of time for refreshing all of the pixels is Tf, and a total number of the drive blocks is N, a period of time for detecting the threshold voltage of the drive transistor is at most Tf/N.

7. A method of driving a display device in which pixels are arranged in rows and columns and compose at least two drive blocks, each of the drive blocks including at least two of the rows, each of the pixels including a drive transistor and a light-emitting element, the drive transistor converting one of a luminance signal voltage and a reference voltage supplied from one of signal lines into a signal current corresponding to the one of the luminance signal voltage and the reference voltage, the light-emitting element emitting light according to a flow of the signal current, the method comprising:

storing a voltage corresponding to a threshold voltage of a corresponding drive transistor in a first capacitive element and a second capacitive element of each of the pixels, simultaneously, in a kth drive block of the drive blocks, k being a positive integer;

storing a summed voltage, in a pixel row-sequence, in the first capacitive element and the second capacitive element of each of the pixels in the kth drive block, after the storing of the voltage in the kth drive block, the summed voltage being obtained by adding a voltage corresponding to the luminance signal voltage to the voltage corresponding to the threshold voltage; and storing a voltage corresponding to a threshold voltage of a corresponding drive transistor in the first capacitive element and the second capacitive element of each of the pixels, simultaneously, in a (k+1)th drive block of the drive blocks, after the storing of the voltage in the kth drive block, wherein the storing of the voltage in the kth drive block includes:

applying an initializing voltage to a gate of the drive transistor of each of the pixels, simultaneously, in the kth drive block by supplying the reference voltage from a first signal line disposed in each of the columns, the initializing voltage causing a gate-source voltage of the drive transistor to be higher than or equal to the threshold voltage; and causing non-conduction between the light-emitting element and the drive transistor of each of the pixels, simultaneously, in the kth drive block, after the applying of the initializing voltage in the kth drive block, the storing of the voltage in the (k+1)th drive block includes:

applying the initializing voltage to the gate of the drive transistor of each of the pixels, simultaneously, in the (k+1)th drive block by supplying the reference voltage from a second signal line different from the first signal line and disposed in each of the columns; and causing non-conduction between the light-emitting element and the drive transistor of each of the pixels, simultaneously, in the (k+1)th drive block, after applying the initializing voltage in the (k+1)th drive block, and the storing of the voltage in the (k+1)th drive block is performed in a period in which the storing of the summed voltage in the kth drive block is performed.

8. The method of driving a display device according to claim 7, wherein the drive transistor includes a source and a drain, one of the source and the drain being connected to a first power source line, the light-emitting element includes terminals, one of the terminals being connected to a second power source line and the other of the terminals being connected to the other of the source and the drain of the drive transistor via a second switching transistor that includes a gate connected to a first control line disposed in each of the rows, and a source and a drain which are arranged between the other of the source and the drain of the drive transistor and the other of the terminals of the light-emitting element, in the applying of the initializing voltage in the kth drive block, the initializing voltage is simultaneously applied to the gate of the drive transistor of each of the pixels in the kth drive block by turning ON a third switching transistor and turning ON a first switching transistor, in a state in which the second switching transistor is ON, the third switching transistor including a gate connected to a scanning line disposed in each of the rows, one of a source and a drain connected to the first signal line, and the other of the source and the drain connected to an other of terminals of the first capacitive element, and the first switching transistor including a gate connected to a second control line disposed in each of the rows, one of a source and a drain connected to the gate of the drive transistor, and the other of the source and the drain connected to the drain of the drive transistor, in the causing of the non-conduction in the kth drive block, (i) the threshold voltage of the drive transistor in each of the pixels in the kth drive block is detected by turning OFF the second switching transistor of each of the pixels in the kth drive block, and (ii) the detected threshold voltage is stored in the first capacitive element or the second capacitive element, in the applying of the initializing voltage in the (k+1)th drive block, the initializing voltage is simultaneously applied to the gate of the drive transistor of each of the pixels in the (k+1)th drive block by turning ON a fourth switching transistor and turning ON a first switching transistor, in a state in which the second switching transistor is ON, the fourth switching transistor including a gate connected to the scanning line, one of a source and a drain connected to the second signal line, and the other of the source and the drain connected to an other of the terminals of the first capacitive element, and the first switching transistor including a gate connected to the second control line, one of a source and a drain connected to the gate of the drive transistor, and the other of the source and the drain connected to the drain of the drive transistor, in the causing of the non-conduction in the (k+1)th drive block, (i) the threshold voltage of the drive transistor in each of the pixels in the (k+1)th drive block is detected by turning OFF the second switching transistor of each of the pixels in the (k+1)th drive block, and (ii) the detected threshold voltage is stored in the first capacitive element or the second capacitive element, and in the storing of the summed voltage in the kth drive block, the voltage corresponding to the luminance signal voltage supplied from the first signal line is applied to the gate of the drive transistor, by turning ON the third switching transistor.

9. The method of driving a display device according to claim 7, further comprising emitting the light by simultaneously supplying the signal current, as a drain current of the drive transistor, to the light-emitting element of each of the pixels in the kth drive block, after the storing of the summed voltage in the kth drive block.

10. The method of driving a display device according to claim 7, further comprising:

storing a summed voltage, in the pixel row-sequence, in the first capacitive element and the second capacitive element of each of the pixels in the (k+1)th drive block, after the storing of the voltage in the (k+1)th drive block, the summed voltage being obtained by adding the voltage corresponding to the luminance signal voltage to the voltage corresponding to the threshold voltage; and emitting the light by simultaneously supplying the signal current, as the drain current of the drive transistor, to the light-emitting element of each of the pixels in the (k+1) th drive block, after the storing of the summed voltage in the (k+1)th drive block.

* * * * *